US008411887B2

(12) United States Patent
Iwakuni et al.

(10) Patent No.: US 8,411,887 B2
(45) Date of Patent: Apr. 2, 2013

(54) HEARING AID, RELAY DEVICE, HEARING-AID SYSTEM, HEARING-AID METHOD, PROGRAM, AND INTEGRATED CIRCUIT

(75) Inventors: Kaoru Iwakuni, Mie (JP); Takashi Katayama, Kanagawa (JP); Yui Ishizaka, Kyoto (JP)

(73) Assignee: Panasonic Corporation, Osaka (JP)

( * ) Notice: Subject to any disclaimer, the term of this patent is extended or adjusted under 35 U.S.C. 154(b) by 188 days.

(21) Appl. No.: 13/057,817

(22) PCT Filed: Jun. 4, 2010

(86) PCT No.: PCT/JP2010/003758

§ 371 (c)(1),
(2), (4) Date: Feb. 7, 2011

(87) PCT Pub. No.: WO2010/143393

PCT Pub. Date: Dec. 16, 2010

(65) Prior Publication Data

US 2011/0142268 A1 Jun. 16, 2011

(30) Foreign Application Priority Data

Jun. 8, 2009 (JP) ..... 2009-136965

(51) Int. Cl.
*H04R 25/00* (2006.01)

(52) U.S. Cl. ..... 381/315; 381/312

(58) Field of Classification Search ..... 381/312, 381/315–317, 320

See application file for complete search history.

(56) References Cited

U.S. PATENT DOCUMENTS

| | | | |
|---|---|---|---|
| 5,835,610 | A | 11/1998 | Ishige et al. |
| 7,567,828 | B1 | 7/2009 | Burson |
| 7,577,459 | B2 | 8/2009 | Tuomela et al. |
| 2006/0018496 | A1 | 1/2006 | Niederdrank et al. |
| 2006/0039577 | A1 | 2/2006 | Sanguino et al. |
| 2007/0009124 | A1 | 1/2007 | Larsen |
| 2009/0017755 | A1 | 1/2009 | Tomoda |
| 2009/0215398 | A1 | 8/2009 | Adler et al. |
| 2009/0286479 | A1 | 11/2009 | Thoresson et al. |
| 2009/0323569 | A1 | 12/2009 | Wentink |

FOREIGN PATENT DOCUMENTS

| | | |
|---|---|---|
| JP | 9-182192 | 7/1997 |
| JP | 10-285696 | 10/1998 |
| JP | 2000-83296 | 3/2000 |
| JP | 2000-83297 | 3/2000 |
| JP | 2002-238100 | 8/2002 |
| JP | 3431511 | 5/2003 |
| JP | 3431512 | 5/2003 |
| JP | 2006-33853 | 2/2006 |
| JP | 2008-148318 | 6/2008 |
| WO | 2006/023857 | 3/2006 |

OTHER PUBLICATIONS

International Search Report issued Jul. 6, 2010 in corresponding International Application No. PCT/JP2010/003758.

*Primary Examiner* — Suhan Ni
(74) *Attorney, Agent, or Firm* — Wenderoth, Lind & Ponack, L.L.P.

(57) ABSTRACT

A hearing aid (51) includes: a sound collecting unit (500) configured to collect one of propagation sounds respectively output from external apparatuses; a radio wave receiving unit (560) that is an exemplary receiving unit configured to receive transmission audio signals transmitted from the respective external apparatuses; a comparing unit (550) configured to compare the propagation sound collected by the sound collecting unit (500) with each of the transmission audio signals received by the radio wave receiving unit (560), and select one of the transmission audio signals that corresponds to the propagation sound; and a sound output unit (520) configured to output, to the user, the sound obtained from the transmission audio signal selected by the comparing unit.

7 Claims, 23 Drawing Sheets

HEARING AID, RELAY DEVICE, HEARING-AID SYSTEM, HEARING-AID METHOD, PROGRAM, AND INTEGRATED CIRCUIT

TECHNICAL FIELD

The present invention relates to hearing aids, relay devices, and hearing-aid systems which have functions for cooperating with audio visual apparatuses.

BACKGROUND ART

In recent years, hearing-aid systems mainly including hearing aids have been remarkably developed, and various kinds of value-added products are about to be on the market.

A well-known problem that occurs when a user of a hearing aid listens to sound from an AV apparatus or the like represented by a television set is that the user has difficulty in listening to the sound from the AV apparatus due to various factors such as surrounding sounds amplified together with the desired sound by the hearing aid.

In order to facilitate listening to desired sound from an AV apparatus, various kinds of systems have been conventionally provided which are intended to transmit, wirelessly or by a radio wave, sounds output from an AV apparatus or the like to a hearing aid. For example, PTL (Patent Literature) 1 and PTL (Patent Literature) 2 disclose a radio wave relay transmission technique of transmitting sounds to a hearing aid using analog FM electric wave and magnetic field induction, taking a specific example of an AV apparatus or the like intended for guidance announcement in a public space. Furthermore, PTL (Patent Literature) 3 discloses, as a technique similar to the above technique, a radio wave relay transmission technique obtained by combining a short-distance digital radio communication in the Bluetooth standard and magnetic field induction communication. According to this technique, it is possible to easily transmit, by a radio wave, audio signals from an AV apparatus to a hearing aid by connecting a radio wave adaptor or the like that supports the BlueTooth standard to the AV apparatus.

CITATION LIST

Patent Literature

[PTL 1]
Patent Application Publication No. 3431511
[PTL 2]
Patent Application Publication No. 3431512
[PTL 3]
International Publication No. WO2006/023857

SUMMARY OF INVENTION

Technical Problem

However, the conventional techniques have been conceived on assumption that a single audio visual apparatus is present as a transmission source, and thus do not provide any effective scheme for solving a problem that occurs in the case where plural audio visual apparatuses are present as transmission sources.

For example, when there are plural FM transmitting apparatuses, the techniques in PTL 1 and PTL 2 require specifying an FM electric wave that should be transmitted by relay from among the plural FM electric waves transmitted from the respective FM transmitting apparatuses. Furthermore, the techniques require some operations for selecting the specified FM electric wave. Likewise, the technique disclosed in PTL 3 requires some operations such as plural times of mutual authentication operations or selection and connection operations when plural BlueTooth radio wave adaptors are present.

There is a problem that such selection operations in the conventional techniques are complicated and thus difficult especially for elderly people who account for most of the users of hearing aids.

Furthermore, a time delay problem occurs especially when a digital radio wave technique such as BlueTooth is used as in PTL 3 in a path for radio wave transmission from audio visual apparatuses to a hearing aid. In general, sounds transmitted by radio waves from audio visual apparatuses or the like are acoustically amplified by speakers in most cases. In this case, a time difference due to time delay occurs between a sound that propagates in the air and directly reaches ears and a sound that is transmitted by a radio wave and output from a hearing aid. In the case where the sound from the hearing aid is output with a delay from the time of output of the sound that will directly reach the ears, especially a user who has a slight hearing disorder and is capable of hearing the directly-reaching sound to some extent suffers from the adverse effect of difficulty in hearing the directly-reaching sound.

The present invention has been conceived to solve the conventional problems, and has an aim to provide a highly user-friendly hearing aid system which simplifies operations for switching connections between apparatuses by automatically selecting an audio visual apparatus to be connected.

Solution to Problem

A hearing aid according to an aspect of the present invention is intended to output, to a user, a sound obtained from a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds. More specifically, the hearing aid includes a sound collecting unit configured to collect one of the propagation sounds output from the respective external apparatuses; a receiving unit configured to receive the transmission audio signals transmitted from the respective external apparatuses; a comparing unit configured to compare the propagation sound collected by the sound collecting unit with each of the transmission audio signals received by the receiving unit, and select one of the transmission audio signals that corresponds to the propagation sound; and a sound output unit configured to output, to the user, the sound obtained from the transmission audio signal selected by the comparing unit.

With this structure, it is possible to automatically switch connections between the hearing aid and the plural external apparatuses without performing any special operation.

In addition, the comparing unit may be configured to calculate a correlation value between a waveform of the propagation sound and a waveform of a sound obtained from each of the transmission audio signals, and select, from among the transmission audio signals, a transmission audio signal having a correlation value exceeding a predetermined threshold value.

With this structure, it is possible to automatically switch the connections between the hearing aid and the external apparatuses in the proximity of the user of the hearing aid without performing any special operation.

Furthermore, the hearing aid may include: a delay amount calculating unit configured to calculate a delay time of the transmission audio signal with respect to the propagation sound, by comparing collecting timing of the propagation sound collected by the sound collecting unit with receiving timing, in the receiving unit, of the transmission audio signal selected by the comparing unit; and a transmitting unit configured to transmit, through the first transmission path, a control signal for causing the external apparatus which outputs the transmission audio signal selected by the comparing unit to output the propagation sound with a delay corresponding to the delay time calculated by the delay amount calculating unit.

With this structure, it is possible to reduce the arrival time difference between the sound that propagates in the air and reaches the hearing aid (user) and the sound that is transmitted through a radio wave transmission path or the like and reaches the hearing aid, and thereby facilitating listening of the sound.

In addition, each of the external apparatuses may superimpose apparatus identification information for identifying the external apparatus on the propagation sound and the transmission audio signal, and output the resulting propagation sound and the resulting transmission audio signal. Furthermore, the comparing unit may be configured to select, from among the transmission audio signals, the transmission audio signal that includes superimposed apparatus identification information identical to the apparatus identification information superimposed on the propagation sound.

With this structure, it is possible to automatically switch the connections between the hearing aid and the external apparatuses in the proximity of the user of the hearing aid more accurately without performing any special operation.

In addition, the sound collecting unit may be configured to collect a compound propagation sound including the propagation sound and a sound produced around the user. Furthermore, the sound output unit may include: a mixing unit configured to mix, at a predetermined mixing ratio, the compound propagation sound collected by the sound collecting unit and the sound obtained from the transmission audio signal selected by the comparing unit; and an amplifying unit configured to amplify the sound mixed by the mixing unit, and output the amplified sound to the user.

In this way, it is possible to amplify even a sound produced around the user in addition to the sound of the transmission audio signal, and thereby allow the user to listen to the sounds.

Furthermore, the hearing aid may include a notifying unit configured to notify the user that the compound propagation sound and the sound obtained from the transmission audio signal have been mixed by the mixing unit.

In this way, the user of the hearing aid can find out whether or not the transmission audio signal has already been amplified and output.

A relay device according to an aspect of the present invention is intended to relay, to a hearing aid, a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds. More specifically, the relay device include: a sound collecting unit configured to collect one of the propagation sounds output from the respective external apparatuses; a receiving unit configured to receive the transmission audio signals output from the respective external apparatuses; a comparing unit configured to compare the propagation sound collected by the sound collecting unit with each of the transmission audio signals received by the receiving unit, and select one of the transmission audio signals that corresponds to the propagation sound; and a transmitting unit configured to transmit the transmission audio signal selected by the comparing unit to the hearing aid through a second transmission path different from the first transmission path.

In addition, the comparing unit may be configured to calculate a correlation value between a waveform of the propagation sound and a waveform of a sound obtained from each of the transmission audio signals, and select, from among the transmission audio signals, a transmission audio signal having a correlation value exceeding a predetermined threshold value.

Furthermore, the relay device may include: a delay amount estimating unit configured to estimate a delay time of the transmission audio signal with respect to the propagation sound, by comparing collecting timing of the propagation sound collected by the sound collecting unit with receiving timing, by the hearing aid, of the transmission audio signal transmitted by the transmitting unit; and a transmitting unit configured to transmit, through the first transmission path, a control signal for causing the external apparatus which outputs the transmission audio signal selected by the comparing unit to output the propagation sound with a delay corresponding to the delay time estimated by the delay amount estimating unit.

A hearing-aid system according to an aspect of the present invention includes external apparatuses as output sources of sounds and a hearing aid which outputs one of the sounds to a user. Each of the external apparatuses includes: an output unit configured to output a propagation sound that propagates in air; and a transmitting unit configured to transmit, on a first transmission path, a transmission audio signal corresponding to the propagation sound. The hearing aid includes: a sound collecting unit configured to collect one of the propagation sounds output from the respective external apparatuses; a receiving unit configured to receive the transmission audio signals output from the respective external apparatuses; a comparing unit configured to compare the propagation sound collected by the sound collecting unit with each of the transmission audio signals received by the receiving unit, and select one of the transmission audio signals that corresponds to the propagation sound; and a sound output unit configured to output, to the user, the sound obtained from the transmission audio signal selected by the comparing unit.

A hearing-aid system according to another aspect of the present invention includes external apparatuses as output sources of sounds, a hearing aid which outputs one of the sounds to a user, and a relay device which relays, to the hearing aid, a sound obtained from one of the external apparatuses. Each of the external apparatuses includes: an output unit configured to output a propagation sound that propagates in air; and a first transmitting unit configured to transmit, on a first transmission path, a transmission audio signal corresponding to the propagation sound. The relay device includes: a sound collecting unit configured to collect one of the propagation sounds output from the respective external apparatuses; a first receiving unit configured to receive the transmission audio signals output from the respective external apparatuses; a comparing unit configured to compare the propagation sound collected by the sound collecting unit with each of the transmission audio signals received by the first receiving unit, and select one of the transmission audio signals that corresponds to the propagation sound; and a second transmitting unit configured to transmit the transmission audio signal selected by the comparing unit to the hearing aid through a second transmission path different from the first transmission path. The hearing aid includes: a second receiving unit configured to receive the transmission audio signal transmitted from the relay device through the second transmission path; and a sound output unit configured to output, to the user, the sound obtained from the transmission audio signal received by the second receiving unit.

A hearing-aid method according to an aspect of the present invention is intended to output, to a user, a sound obtained from a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds. More specifically, the hearing-aid method includes: collecting one of the propagation sounds output from the respective external apparatuses; receiving the transmission audio signals transmitted from the respective external apparatuses; comparing the propagation sound collected in the collecting with each of the transmission audio signals received in the receiving, and select one of the transmission audio signals that corresponds to the propagation sound; and outputting, to the user, the sound obtained from the transmission audio signal selected in the comparing.

A program according to an aspect of the present invention is intended to cause a hearing aid to output, to a user, a sound obtained from a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds. More specifically, the hearing-aid method includes: collecting one of the propagation sounds output from the respective external apparatuses; receiving the transmission audio signals transmitted from the respective external apparatuses; comparing the propagation sound collected in the collecting with each of the transmission audio signals received in the receiving, and select one of the transmission audio signals that corresponds to the propagation sound; and outputting, to the user, the sound obtained from the transmission audio signal selected in the comparing.

An integrated circuit according to an aspect of the present invention is intended to output, to a user, a sound obtained from a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds. More specifically, the integrated circuit includes: a sound collecting unit configured to collect one of the propagation sounds output from the respective external apparatuses; a receiving unit configured to receive the transmission audio signals transmitted from the respective external apparatuses; a comparing unit configured to compare the propagation sound collected by the sound collecting unit with each of the transmission audio signals received by the receiving unit, and select one of the transmission audio signals that corresponds to the propagation sound; and a sound output unit configured to output, to the user, the sound obtained from the transmission audio signal selected by the comparing unit.

Advantageous Effects of Invention

According to the present invention, it is possible to automatically switch connections between a hearing aid and each of audio visual apparatuses without performing any special operation.

DESCRIPTION OF EMBODIMENTS

Embodiments of the present invention will be described below with reference to the drawings. The same elements are assigned with the same reference signs, and the descriptions thereof may not be repeated.

Embodiment 1

A hearing-aid system according to another aspect of the present invention includes external apparatuses as output sources of sounds, a hearing aid which outputs one of the sounds to a user, and a relay device which relays, to the hearing aid, a sound obtained from one of the external apparatuses. Each of the external apparatuses includes: an output unit configured to output a propagation sound that propagates in air; and a first transmitting unit configured to transmit, on a first transmission path, a transmission audio signal corresponding to the propagation sound. The relay device includes: a sound collecting unit configured to collect one of the propagation sounds output from plural external apparatuses including the respective external apparatuses; a first receiving unit configured to receive the transmission audio signals output from the plural external apparatuses including the respective external apparatuses; a comparing unit configured to compare the propagation sound collected by the sound collecting unit with each of the transmission audio signals received by the first receiving unit, and select one of the transmission audio signals that corresponds to the propagation sound; and a second transmitting unit configured to transmit the transmission audio signal selected by the comparing unit to the hearing aid through a second transmission path different from the first transmission path. The hearing aid includes: a second receiving unit configured to receive the transmission audio signal transmitted from the relay device through the second transmission path; and a sound output unit configured to output, to the user, the sound obtained from the transmission audio signal received by the second receiving unit.

Figure 1:
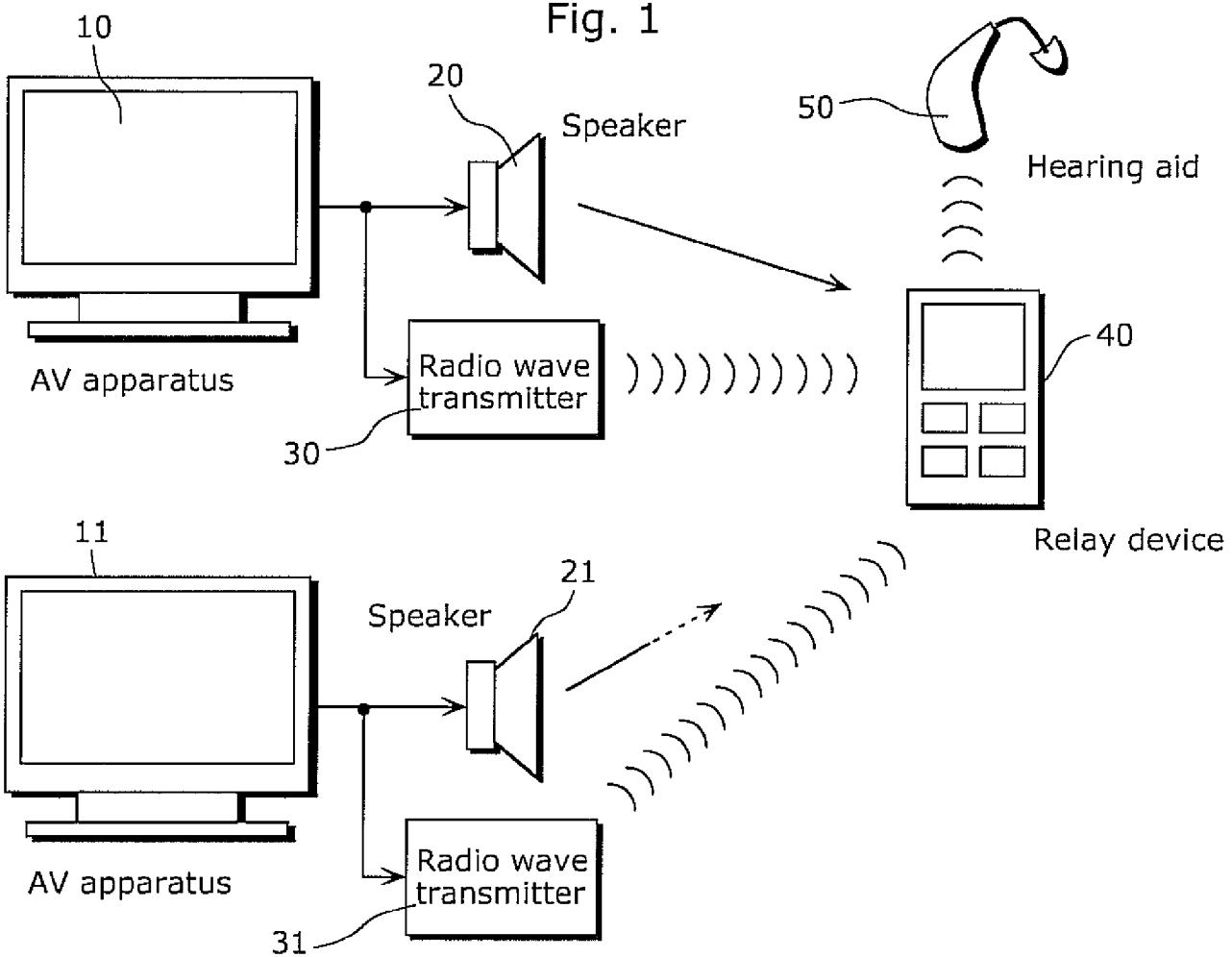
FIG. 1 is a structural diagram of a hearing aid system in Embodiment 1.

With reference to FIG. 1, a description is given of a structure of a hearing-aid system according to Embodiment 1 of the present invention. This hearing-aid system includes an AV apparatus (audio visual apparatus) 10 that is a first external apparatus, an AV apparatus (audio visual apparatus) 11 that is a second external apparatus, a relay device 40, and a hearing aid 50.

The AV apparatuses 10 and 11 include speakers 20 and 21 that are amplifying units (output units) and radio wave transmitters 30 and 31 that are radio wave transmitting units (transmitting units), respectively. The speakers 20 and 21 in the AV apparatuses 10 and 11 output audio signals as propagation sounds that propagate in the air to the relay device 40 and the hearing aid 50. The radio wave transmitters 30 and 31 in the AV apparatuses 10 and 11 transmit audio signals as radio wave transmission audio signals that are transmitted by radio waves to the relay device 40 through a first transmission path.

Although examples of such a first transmission path are not specifically limited, radio wave communication paths such as wireless LAN (Local Area Network) defined by IEEE802.11, Bluetooth, etc. are desirable. The first transmission path may be simply referred to as "radio wave or wireless" in the following descriptions. Here, the radio wave transmission audio signal that is output from the radio wave transmitter 30 in the AV apparatus 10 is different, for example in transmission frequency, from the radio wave transmission audio signal that is output from the radio wave transmitter 31 in the AV apparatus 11.

Figure 2:
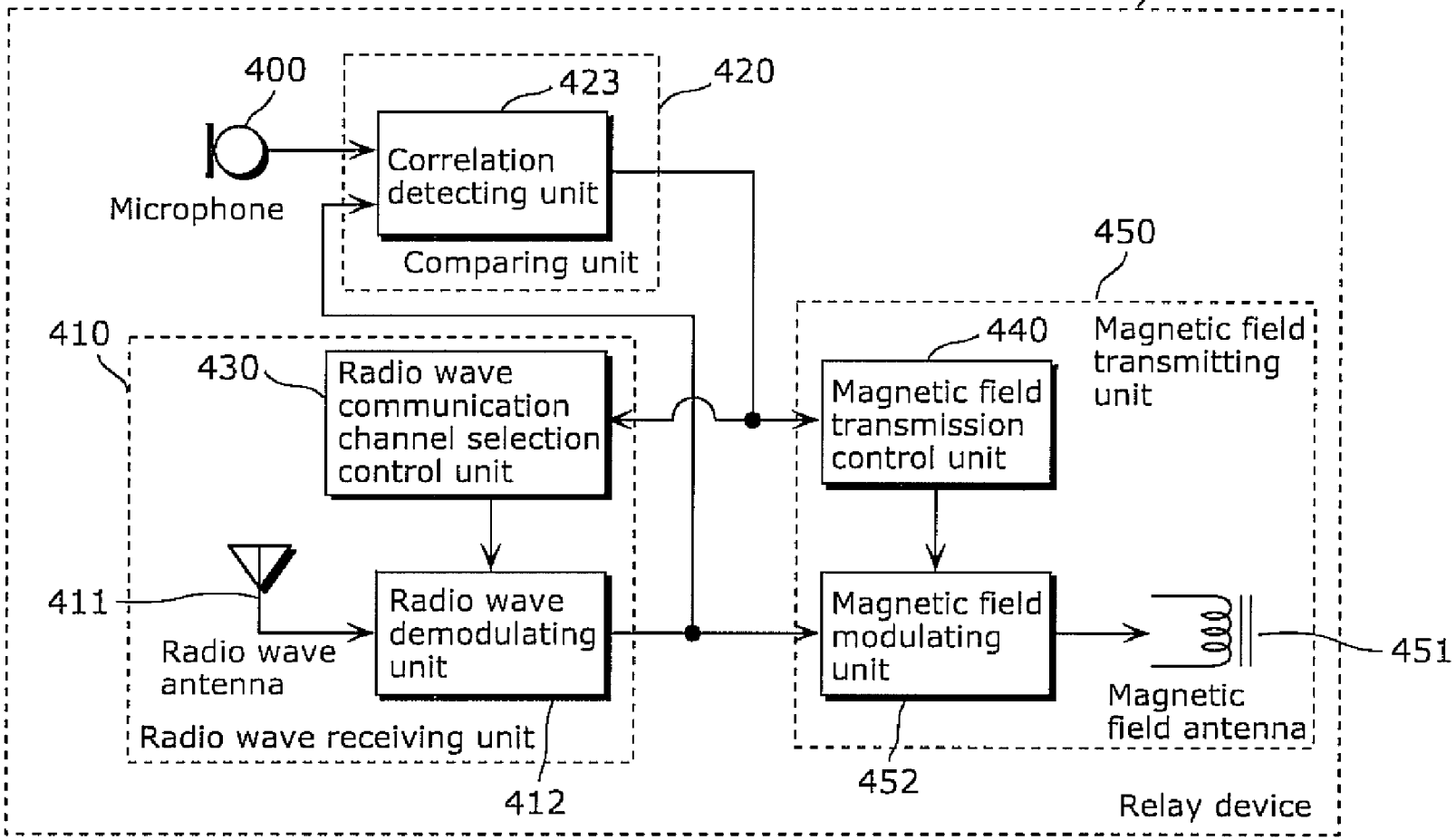
FIG. 2 is a functional block diagram of a relay device in Embodiment 1.

Next, a description is given of a structure of the relay device 40 with reference to FIG. 2 that is a functional block diagram of the relay device 40. The relay device 40 includes a microphone 400 that is a sound collecting unit, a radio wave receiving unit 410 that is a receiving unit configured to receive a radio wave transmission audio signal transmitted by a radio wave, a comparing unit 420, and a magnet transmitting unit 450 that is a transmitting unit configured to transmit a magnetic field signal transmitted by a magnetic field to the hearing aid 50 through the second transmission path.

The microphone 400 collects a sound that propagates in the air. The microphone 400 collects a sound produced around the user, in addition to the propagation sound that is output from the speakers 20 and 21. More specifically, the microphone 400 collects a compound propagation sound that includes a propagation sound output from at least one of the speakers 20 and 21 and the sound produced around the user.

Here, the propagation sound output from the speakers 20 and 21 attenuates before reaching the microphone 400, and the propagation sound output from the speakers 20 and 21 may not precisely identical to the propagation sound collected by the microphone 400.

The radio wave receiving unit 410 includes a radio wave antenna 411, a radio wave demodulating unit 412, a radio wave communication channel selection control unit 430. The radio wave antenna 411 receives a radio wave transmission audio signal transmitted from the AV apparatuses 10 and 11. The radio wave demodulating unit 412 demodulates the radio wave transmission audio signal received by the radio wave antenna 411, and outputs the demodulated audio signal to the comparing unit 420 and the magnetic field transmitting unit 450. The radio wave communication channel selection control unit 430 specifies a frequency band that should be received, and thereby causing the radio wave antenna 411 and the radio wave demodulating unit 412 to receive the radio wave transmission audio signal having a particular frequency band. More specifically, the radio wave communication channel selection control unit 430 switches frequency bands to receive, and thereby being able to sequentially receive radio wave transmission audio signals output from the AV apparatuses 10 and 11.

The comparing unit 420 shown in FIG. 1 includes a correlation detecting unit 423 configured to calculate a correlation value between a waveform of the propagation sound collected by the microphone 400 and a waveform of the audio signal (sound) obtained from each of the radio wave transmission audio signals received by the radio wave antenna 411, and select, from among the radio wave transmission audio signals, a radio wave transmission audio signal having a correlation value exceeding a predetermined threshold value. Alternatively, the correlation detecting unit 423 may select the radio wave transmission audio signal that has the highest correlation value with the propagation sound from among the radio wave transmission audio signals.

Figure 3:
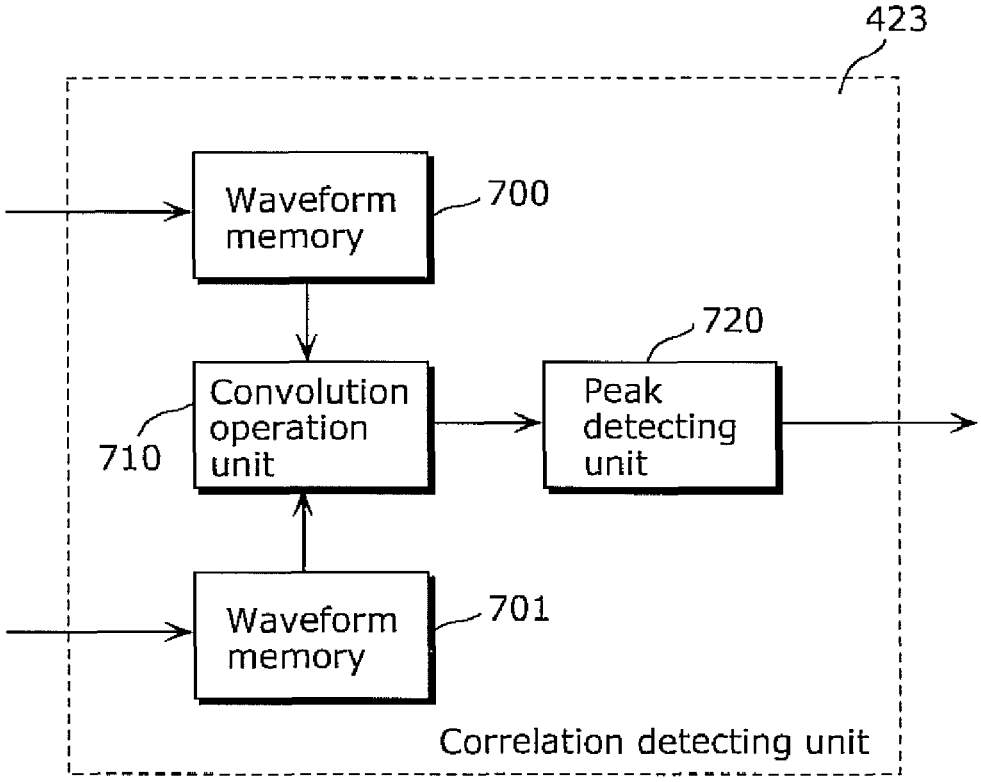
FIG. 3 is a functional block diagram of a correlation detecting unit in Embodiment 2.

With reference to FIG. 3, the structure of the correlation detecting unit 423 is described more specifically. The correlation detecting unit 423 shown in FIG. 3 includes waveform memories 700 and 701, a convolution operation unit 710, and a peak detecting unit 720.

The waveform memory 700 temporarily stores the waveform that is of the propagation sound collected by the microphone 400 and corresponds to a predetermined time. The waveform memory 701 temporarily stores the waveform that is of the audio signal output by the radio wave demodulating unit 412 and corresponds to a predetermined time period. Here, it is desirable that the waveform memories 700 and 701 have a storage capacity for storing signal waveforms corresponding to a time period at least twice the delay time (to be described later) between the propagation sound and the radio wave transmission audio signal.

Examples of the waveform memories 700 and 701 are not specifically limited. For example, it is possible to employ various kinds of data recording media such as a DRAM (Dynamic random access memory), a SRAM (Static random access memory), a flash memory, and an HDD (Hard Disc Drive).

The convolution operation unit 710 performs convolution operation on the waveform of the propagation sound stored in the waveform memory 700 and the waveform of the audio signal stored in the waveform memory 701 such that these waveforms are mutually shifted in time. The peak detecting unit 720 detects presence or absence of a peak, based on a result of the convolution operation by the convolution operation unit 710. Here, it is only necessary for such peak detection to use a conventionally-known differentiation or the like.

The magnetic field transmitting unit 450 includes a magnetic field antenna 451, a magnetic field modulating unit 452, and a magnetic field transmission control unit 440. The magnetic field antenna 451 transmits the audio signal as a magnetic field transmission audio signal that is transmitted by a magnetic field to the hearing aid 50 through the second transmission path. The magnetic field modulating unit 452 modulates the audio signal demodulated by the radio wave demodulating unit 412 into a magnetic field transmission audio signal, and causes the magnetic field antenna 451 to transmit the modulated one. The magnetic field transmission control unit 440 controls the magnetic field modulating unit 452, based on the result of the detection by the correlation detecting unit 423.

Operations by the relay device 40 configured in this way are described below with reference to FIG. 4.

First, the microphone 400 collects a propagation sound that is a sound wave that propagates in the air and reaches the microphone 400. On the other hand, the radio wave receiving unit 410 receives a radio wave transmission audio signal transmitted by a radio wave. The reception of the radio wave transmission audio signal triggers processing, as shown in FIG. 4, of determining one of the AV apparatuses 10 and 11 as a connection source.

When radio wave transmission audio signals are received by the radio wave antenna 411 (YES in Step S101), the radio wave communication channel selection control unit 430 transmits a control signal to the radio wave demodulating unit 412 to cause the radio wave demodulating unit 412 to sequentially output the received radio wave transmission audio signals. The radio wave demodulating unit 412 demodulates the radio wave transmission audio signals according to this control signal, and outputs the demodulated audio signals to the correlation detecting unit 423 (Step S102).

Here, the transmission order indicated by the signal for instruction from the radio wave communication channel selection control unit 430 to the radio wave receiving unit 410 is, for example, a frequency order specified as an order of frequency bands prioritized, for example, from high to low of the radio wave transmission audio signals. In the case where there is other identification information that identifies each of signals based on transmission schemes of the signals, the transmission order may be specified based on the identification information.

The correlation detecting unit 423 detects a correlation between the propagation sound collected by the microphone 400 and the audio signal received by the radio wave receiving unit 410 and demodulated (Step S103). This correlation is determined to be significant, for example, when a correlation function of time signal waveforms or power envelope waveforms are calculated and the calculated correlation function has a peak value equal to or greater than the predetermined threshold value (Step S104). This threshold value may be empirically defined and fixed, or may be variable according to the collected propagation sound and/or the received radio wave transmission audio signal.

In the case where the correlation detecting unit 423 determines that there is a significant correlation in the correlation detection and determination performed in this way (YES in Step S104), the correlation detecting unit 423 outputs information about the determination result to the magnetic field transmission control unit 440. The magnetic field transmission control unit 440 transmits the control signal to the magnetic field modulating unit 452 to cause magnetic field transmission. Based on the control signal, the magnetic field modulating unit 452 modulates the audio signal demodulated by the radio wave demodulating unit 412 into a magnetic field transmission audio signal, and transmits the modulated one to the magnetic field antenna 451. The magnetic field antenna 451 transmits the magnetic field transmission audio signal modulated by the magnetic field modulating unit 452 to the hearing aid 50 through the second transmission path (Step S105).

In the opposite case where the correlation detecting unit 423 determines that there is no significant correlation (NO in Step S104), the correlation detecting unit 423 outputs information about the determination result to the radio wave communication channel selection control unit 430. Upon obtaining the determination result, the radio wave communication channel selection control unit 430 determines whether or not there is a next receivable frequency band (Step S106). In the case where there is a next receivable frequency band (YES in Step S106), the radio wave communication channel selection control unit 430 transmits a control signal to the radio wave antenna 411 and the radio wave demodulating unit 412 so that the next radio wave transmission audio signal is received.

The radio wave receiving unit 410 receives, using the radio wave antenna 411, the radio wave transmission audio signal for which a next determination is made, demodulates the received radio wave transmission audio signal using the radio wave demodulating unit 412, and outputs the demodulated audio signal to the correlation detecting unit 423 (Step S107).

The same processes are repeated hereinafter. In the opposite case where there is no next receivable frequency band (YES in Step S106), the radio wave communication channel selection control unit 430 completes the processing of determining a connection destination for relay. In this way, the relay device 40 can determine, as the connection destination, one of the AV apparatuses 10 and 11 located near the user of the hearing aid 50.

Figure 4:
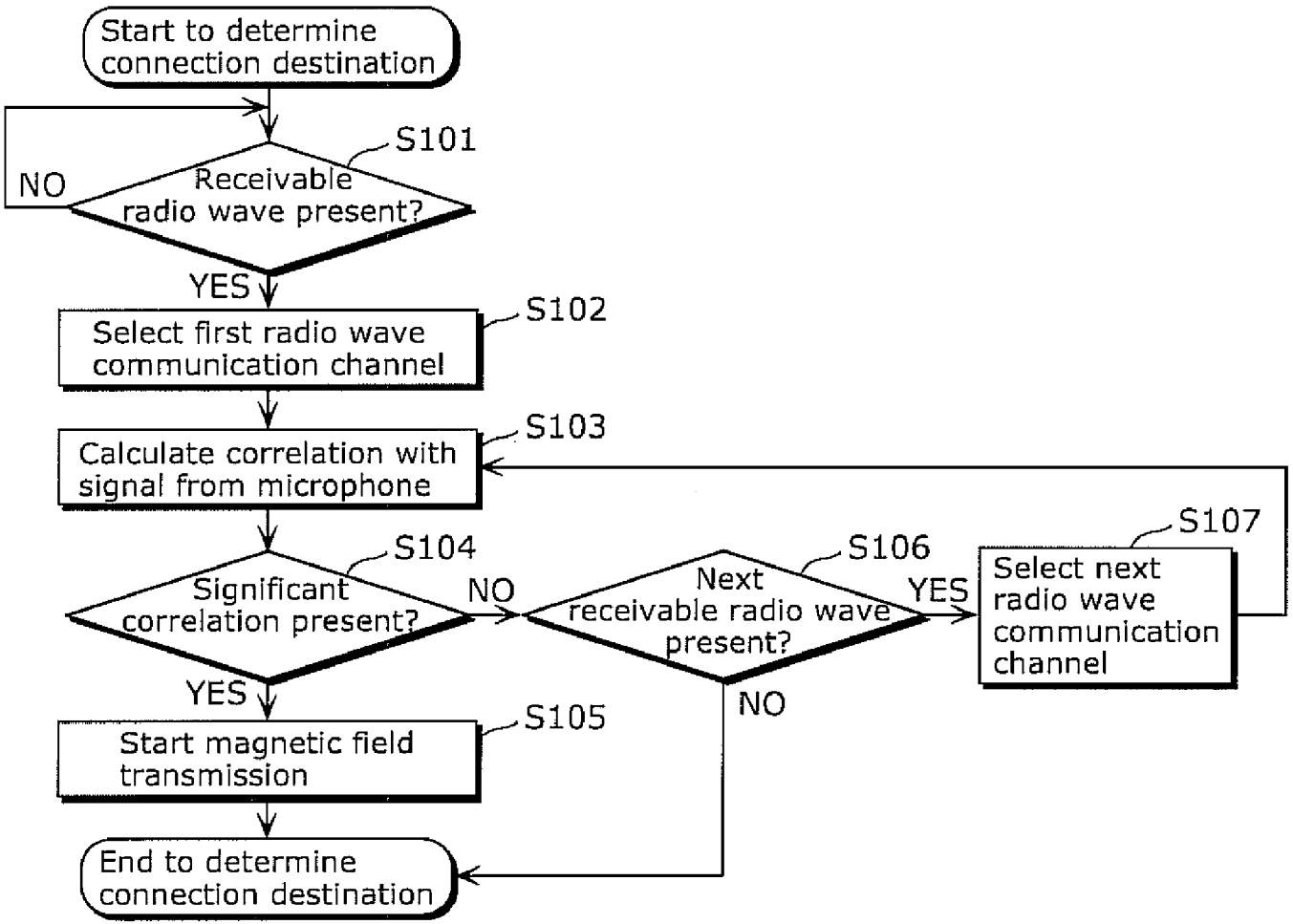
FIG. 4 is a flowchart of connection destination determination processing in Embodiment 1.

The connection destination determination processing shown in FIG. 4 is repeated in units of a predetermined time (for example, 500 msec).

Figure 5:
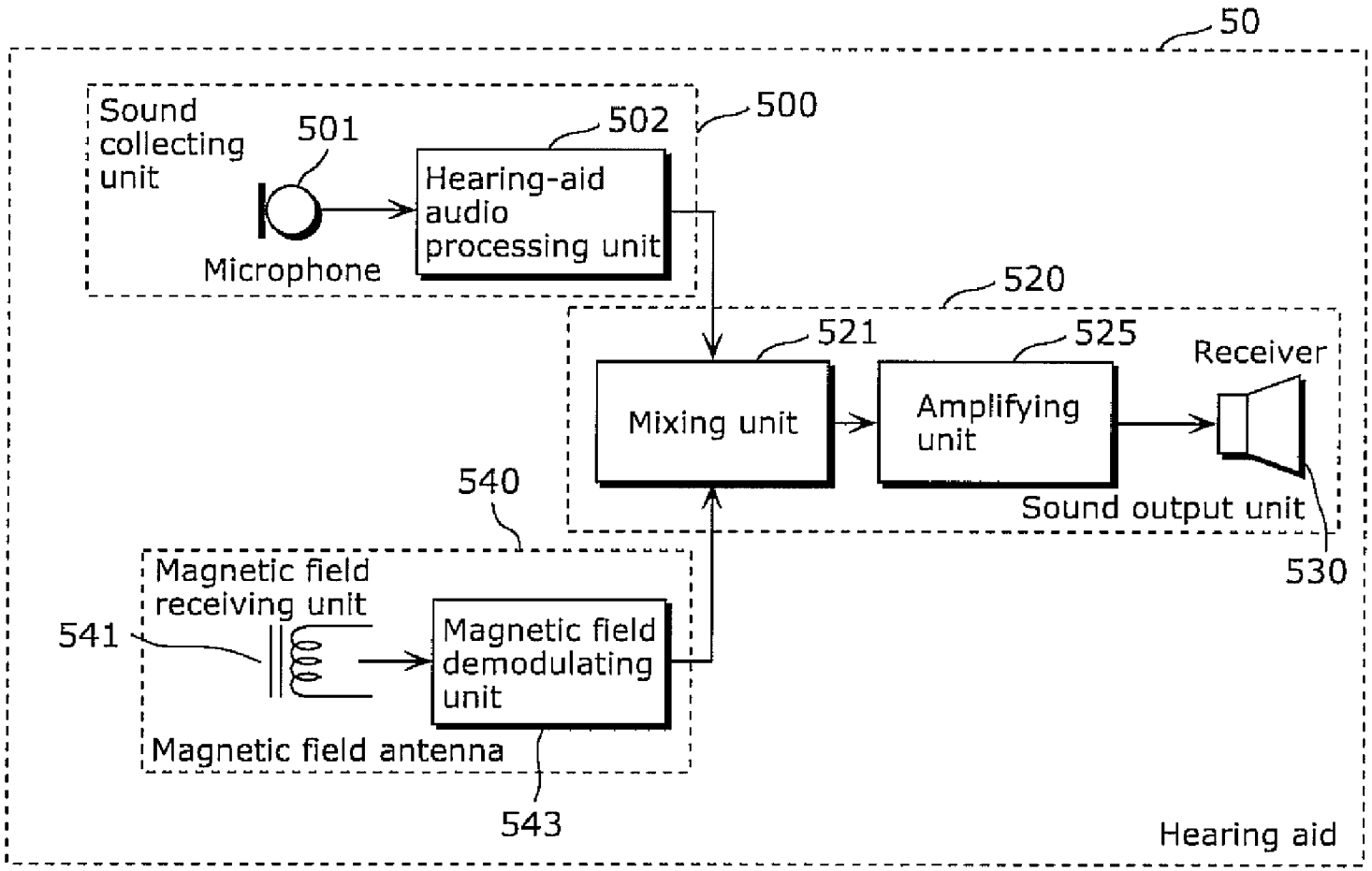
FIG. 5 is a functional block diagram of a hearing aid in Embodiment 1.

Next, a description is given of a structure of the hearing aid 50 with reference to FIG. 5 that is a functional block diagram of the hearing aid 50. The hearing aid 50 includes a sound collecting unit 500, a magnetic field receiving unit 540 that is a receiving unit, and a sound output unit 520.

The sound collecting unit 500 includes a microphone 501 and a hearing aid audio processing unit 502. The microphone 501 collects a propagation sound (or a compound propagation sound) propagating in the air. The hearing aid audio processing unit 502 performs audio processing on the propagation sound collected by the microphone 501.

The magnetic field receiving unit 540 includes a magnetic field antenna 541 and a magnetic field demodulating unit 543. The magnetic field antenna 541 receives the magnetic field transmission audio signal from the relay device 40 through the second transmission path. The magnetic field demodulating unit 543 demodulates the radio wave transmission audio signal received by the magnetic field antenna 541 to obtain an audio signal.

The sound output unit 520 includes a mixing unit 521, an amplifying unit 525, and a receiver 530. The mixing unit 521 mixes, as necessary, the audio signal subjected to the audio processing by the hearing aid audio processing unit 502 and the audio signal received by the magnetic field receiving unit 540. The amplifying unit 525 amplifies the audio signals mixed by the mixing unit 521. The receiver 530 outputs, as a sound wave, the audio signal amplified by the amplifying unit 525.

A description is given of operations performed by the hearing aid 50 configured in this way. The microphone 501 collects a propagation sound that is a sound wave that propagates in the air and reaches the microphone 501. The hearing-aid audio processing unit 502 performs hearing-aid processes such as a noise removal process and a gain adjustment process for facilitating the user to hear the propagation sound collected by the microphone 501.

The magnetic field antenna 541 of the magnetic field receiving unit 540 receives a magnetic field transmission audio signal transmitted by a magnetic field from the relay device 40. The magnetic field demodulating unit 543 demodulates the magnetic field transmission audio signal received by the magnetic field antenna 541, and outputs the demodulated audio signal to the mixing unit 521.

In the case where no demodulated audio signal is output from the magnetic field receiving unit 540, the mixing unit 521 outputs the audio signal subjected to audio processing by the hearing-aid audio processing unit 502 to the amplifying unit 525 as it is. In the opposite case where the magnetic field receiving unit 540 receives the magnetic field transmission audio signal and outputs the demodulated audio signal, the mixing unit 521 mixes the audio signal output from the hearing-aid audio processing unit 502 and the audio signal output from the magnetic field receiving unit 540 to the amplifying unit 525.

This mixing processing can be performed by performing weighted addition using a predetermined mixing ratio held by the mixing unit 521. For example, when the audio signal output from the magnetic field receiving unit 540 and the audio signal output from the hearing-aid audio processing unit 502 are mixed such that the output ratio is 8 to 2, the audio signal output from the magnetic field receiving unit 540 is dominant. In this way, it is possible to decrease the influence of the audio signal of a sound that propagates in the air and thus includes noise or the like and increase the influence of the audio signal transmitted by a radio wave and a magnetic field, and thereby facilitating listening of the desired sound of the audio signal from the audio visual apparatus.

This predetermined mixing ratio may be empirically determined and fixed, or may be modified based on an output signal from the magnetic field receiving unit 540. For example, when the audio visual apparatuses as output sources of audio signals demodulated by the magnetic field receiving unit 540 frequently change, it is highly likely that the audio visual apparatus that is closest to the user of the hearing aid frequently changes because the user frequently moves around. In this case, it is highly likely that the user does not wish to listen to the sound output from the audio visual apparatus so much, it is also possible to make a change to the mixing ratio for prioritizing the output from the hearing-aid audio processing unit 502.

For example, in the case where the audio visual apparatus indicated by the output from the magnetic field receiving unit 540 does not change over a first time period (for example, 10 minutes or more), it is highly likely that the user stays around the audio visual apparatus. In this case, it is highly likely that the user wishes to listen to the sound output from the audio visual apparatus, it is also possible to make a change to the mixing ratio for prioritizing the output from the magnetic field receiving unit 540. This mixing ratio enables output of a sound that is more comfortable to the user.

The amplifying unit 525 amplifies the audio signal mixed by the mixing unit 521 according to the amplification degree that is set by the user using a switch, etc, or hearing information of the user. The receiver 530 outputs the amplified audio signal as a sound wave toward an external auditory canal of the user.

A description is given of operations performed in the whole hearing-aid system configured in this way. In general, as shown in FIG. 1, the two AV apparatuses 10 and 11 are set at spatially distant locations. The audio signal from the AV apparatus 10 is amplified and output by the speaker 20 in the air as a propagation sound, and is transmitted by the radio wave transmitter 30 as a radio wave transmission audio signal. Likewise, the audio signal from the AV apparatus 11 is amplified and output by the speaker 21 in the air as a propagation sound, and is transmitted by the radio wave transmitter 31 as a radio wave transmission audio signal.

Here, for example, the AV apparatuses 10 and 11 are located in different rooms divided by a wall. As known in public, a sound wave that propagates in the air, especially a sound wave having a high frequency is easily blocked by a simple partition or the like. For this, as shown in FIG. 1, in the case where a user wearing a hearing aid 50 and holding a relay device 40 is in a room in which the AV apparatus 10 is set, the relay device 40 receives the propagation sound from the speaker 20, the radio wave transmission audio signal from the radio wave transmitter 30, and the radio wave transmission audio signal from the radio wave transmitter 31.

In this case, the propagation sound from the speaker 20 of the AV apparatus 10 near the user and the radio wave transmission audio signal from the radio wave transmitter 30 have a high correlation. Thus, the relay device 40 outputs, to the hearing aid 50, the radio wave transmission audio signal from the radio wave transmitter 30 as the magnetic field transmission audio signal.

The hearing aid 50 receives the audio signal from the AV apparatus 10 from the radio wave transmitter 30 through the relay device 40. Thus, the user wearing the hearing aid 50 listens to the audio signal from the nearby AV apparatus 10 through the hearing aid 50.

Next, when the user moves out from the room and approaches to the AV apparatus 11, the propagation sound output from the speaker 21 connected to the AV apparatus 11 becomes dominant in the sound wave reaching the microphone of the relay device 40. Here, when the propagation sound from the speaker 21 is dominant, the amount of the propagation sound that is contained in the sound wave (decoded propagation sound) collected by the microphone 400 becomes larger than the amount of the propagation sound output from the speaker 20.

In this situation, it is impossible to detect a correlation between the propagation sound collected by the microphone 400 and the radio wave transmission audio signal received by the radio wave receiving unit 410. When it is impossible to detect such a correlation, the magnetic field transmitting unit 450 stops magnetic field transmission. The magnetic field transmission of a radio wave transmission audio signal output from the radio wave transmitter 31 is started when the propagation sound output from the speaker 21 becomes dominant in the propagation sound that is collected by the microphone while a connection destination determination process shown in FIG. 5 is being repeated.

With this structure, the output from the receiver 530 of the hearing aid 50 is switched, which allows the user who is near the AV apparatus 11 after the movement to listen to the audio signal from the AV apparatus 11. In addition, in this switching, the signal obtained by performing audio processing on the propagation sound collected by the microphone 501 is output from the receiver 530. In this way, the hearing-aid audio processing unit 502 performs appropriate audio processing, which makes it possible to control the switching such that the output of a sound from the receiver 530 does not suddenly stop and does not cause the user to feel great discomfort due to the sudden stoppage.

Although the status in which the AV apparatuses 10 and 11 are set in different rooms is described above, statuses are not limited thereto as a matter of course. For example, the hearing-aid system makes it possible to facilitate listening of audio signals from the AV apparatuses 10 and 11 even when plural AV apparatuses 10 and 11 are set in a place without any object that blocks a sound wave propagating in the air. In other words, naturally, the audio signals from the AV apparatuses 10 and 11 closest to the user wearing the hearing aid 50 places the greatest influence on the sound wave collected by the microphone 400. For this, it is possible to discriminate the propagation sounds from the closest AV apparatuses and 11, based on the correlations between the collected propagation sounds and the radio wave transmission audio signals with little influence of surrounding sounds or the like. Based on the result of the discrimination performed in this way, it is possible to perform mixing and adjustment by appropriate audio processing, and thereby outputting a desired sound from the receiver 530.

In this way, with the hearing-aid system in Embodiment 1, the user wearing the hearing aid 50 and holding the relay device 40 can easily listen to audio signals from the AV apparatuses 10 and 11 only by moving toward the AV apparatuses 10 and 11 as connection targets without performing any special operation. In addition, as described above, when the user moves from the proximity of the AV apparatus 10 to the proximity of the AV apparatus 11, the audio signal output from the hearing aid 50 is switched to an audio signal from the AV apparatus 11 without any special operation, which increases userfriendliness.

A case of using two audio visual apparatuses is described in Embodiment 1, but the number of audio visual apparatuses is not limited thereto. An arbitrary number corresponding to 1 or a greater number of audio visual apparatuses may be applicable as a matter of course. In the case of a single audio visual apparatus, complicated connection operations are unnecessary although no switch is made. When the user of the hearing aid is near the audio visual apparatus, it is possible to facilitate listening of the sound from the apparatus.

In addition, examples of the AV apparatuses 10 and 11 include television sets, video devices, radio sets, stereo devices, theater devices, personal computers, and guidance announcement devices. Signal lines used to connect the AV apparatuses 10 and 11 and the radio wave transmitters 30 and 31 are, for example, analog line signals, optical digital signals, co-axial digital signals, and HDMI-support digital signals. In addition, the speakers 20 and 21 and the radio wave transmitters 30 and 31 may be embedded in the bodies of the AV apparatuses 10 and 11. In this case, it is possible to easily set the system.

In addition, although an example of combining radio wave transmission and magnetic field transmission is described in Embodiment 1, inter-apparatus transmission schemes are not limited thereto. It is possible to arbitrarily combine and use radio waves, magnetic fields, infrared rays, visible light, supersonic waves, etc. Alternatively, the relay device 40 and the hearing aid 50 may be connected using a wire.

In the connection destination processing taken as an example in the above description, a correlation is calculated while sequentially switching radio wave transmission audio signals. However, it is also good to detect the correlations with all the radio wave transmission audio signals first and then select the radio wave transmission audio signal that yields the largest correlation value. In addition, in the case where two or more radio wave transmission audio signals having approximately the same correlation values are found, it is possible to add a process of, for example, selecting the radio wave transmission audio signal having the greatest signal strength according to the signal strengths of the respective radio wave transmission audio signals. In this way, it is possible to determine a connection destination more securely.

Variation of Embodiment 1

Figure 6:
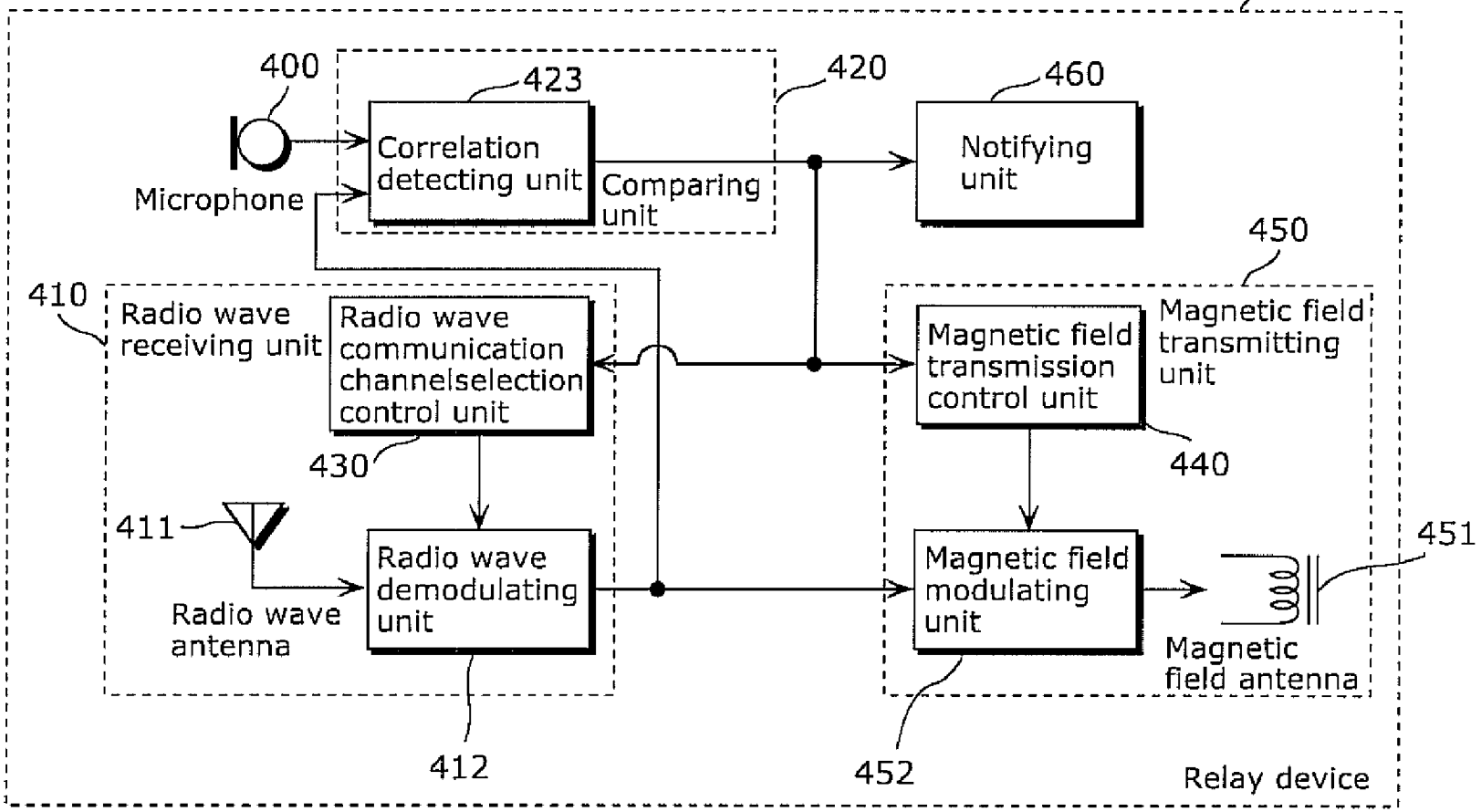
FIG. 6 is a functional block diagram of a relay device in a variation of Embodiment 1.
Figure 7:
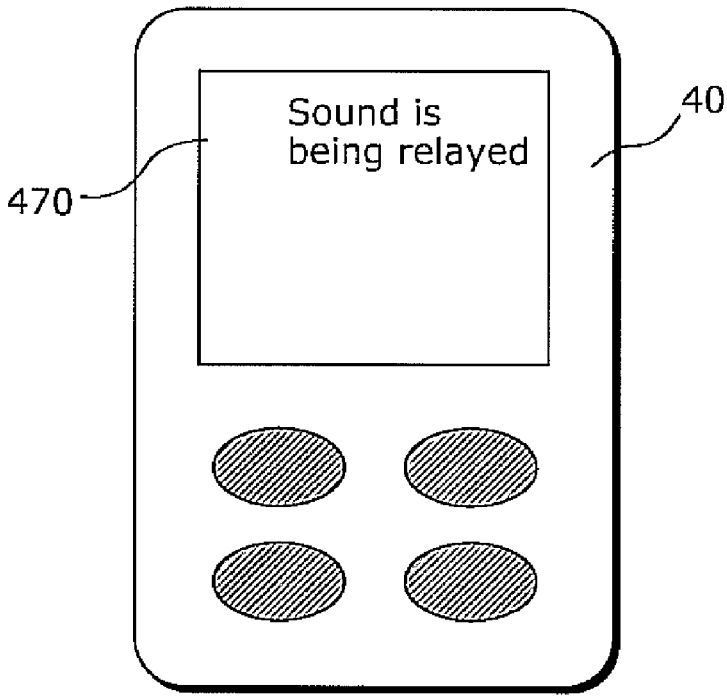
FIG. 7 is an example of an external view of a relay device in the variation of Embodiment 1.
Figure 8:
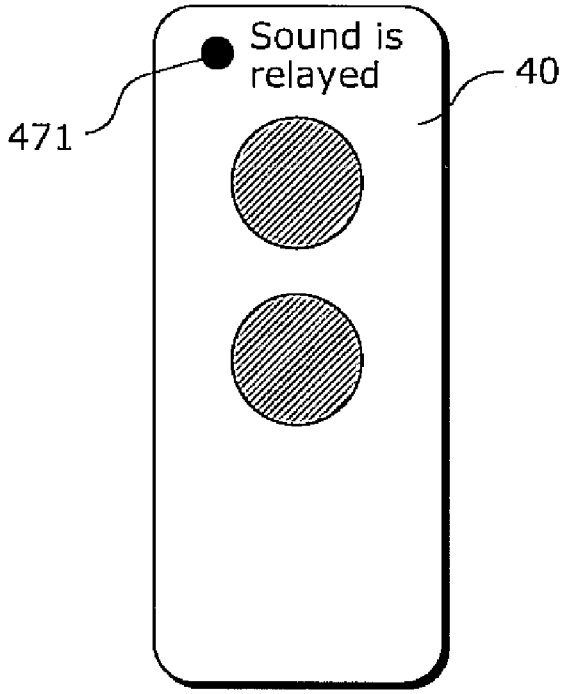
FIG. 8 is another example of an external view of a relay device in the variation of Embodiment 1.

Next, a description is given of a relay device 40 according to a variation of Embodiment 1 with reference to FIG. 6 to FIG. 8. The same structural elements as in Embodiment 1 are assigned with the same reference signs, and the descriptions thereof are not repeated.

The relay device 40 shown in FIG. 6 includes a notifying unit 460, in addition to the structural elements of the relay device 40 shown in FIG. 2. The notifying unit 460 is intended to notify a user that the relay device 40 is relaying a transmission audio signal to the hearing aid 50. More specifically, with the notifying unit 460, the user of the hearing aid 50 can find out whether the sound that is currently heard from the hearing aid 50 is only a propagation sound collected by the microphone 501 or a sound including a sound of the transmission audio signal relayed by the relay device 40.

The specific structure of the notifying unit 460 is not specifically limited. The notifying unit 460 may have a display screen 470 on which "sound is being relayed" or the like is displayed, or may be configured to make a notification of execution of relay processing by turning on (flickering) a LED lamp 471 as shown in FIG. 8.

Embodiment 2

A hearing-aid system according to Embodiment 2 includes external apparatuses as output sources of sounds and a hearing aid which outputs one of the sounds to a user. Each of the external apparatuses includes: an output unit configured to output a propagation sound that propagates in air; and a transmitting unit configured to transmit, on a first transmission path, a transmission audio signal corresponding to the propagation sound. The hearing aid includes: a sound collecting unit configured to collect one of the propagation sounds output from the respective external apparatuses; a receiving unit configured to receive the transmission audio signals output from plural external apparatuses including the respective external apparatuses; a comparing unit configured to compare the propagation sound collected by the sound collecting unit with each of the transmission audio signals received by the receiving unit, and select one of the transmission audio signals that corresponds to the propagation sound; and a sound output unit configured to output, to the user, the sound obtained from the transmission audio signal selected by the comparing unit.

Figure 9:
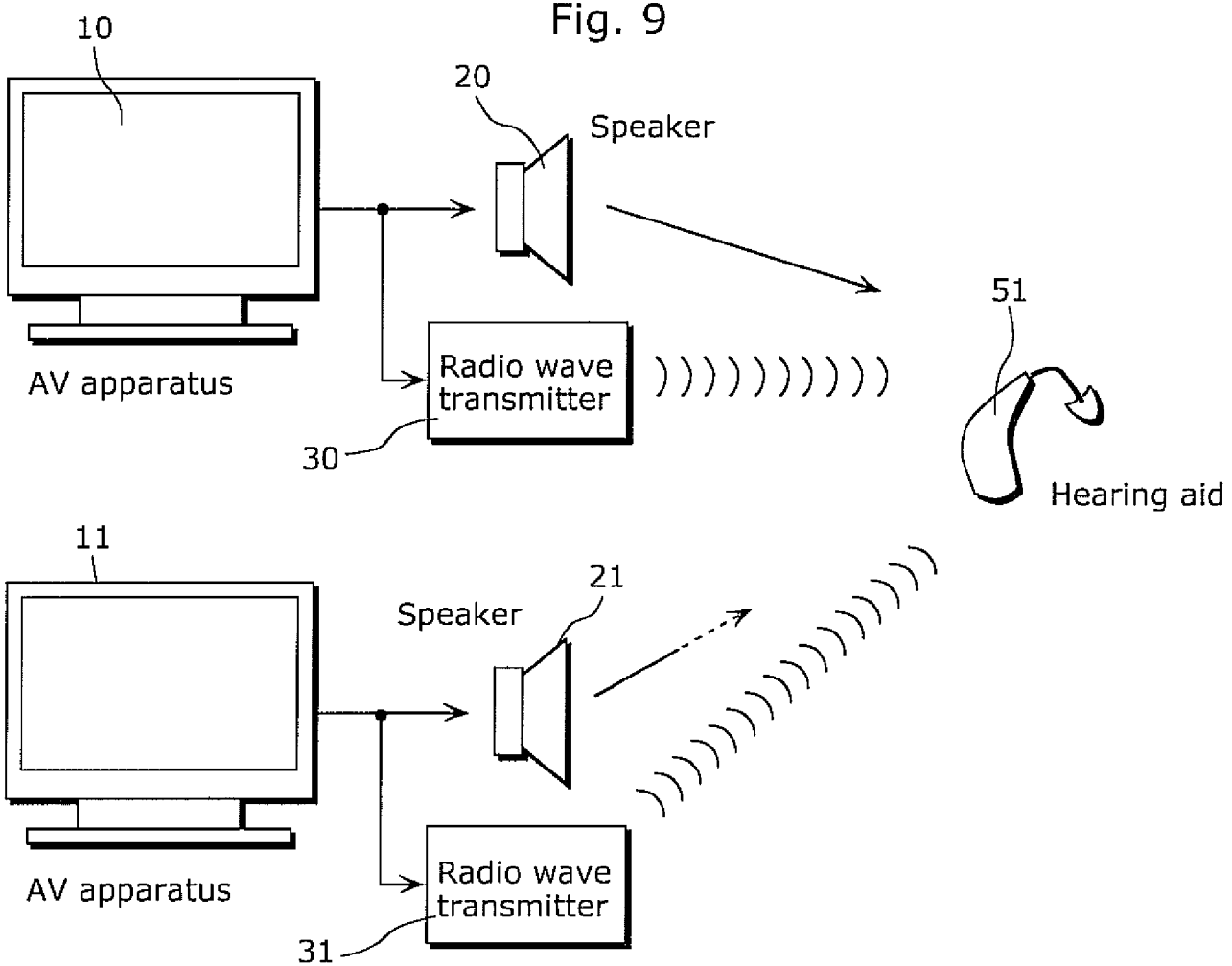
FIG. 9 is a structural diagram of a hearing-aid system in Embodiment 2.

With reference to FIG. 9, a description is given of a structure of a hearing-aid system according to Embodiment 2 of the present invention. The hearing-aid system in Embodiment 2 includes AV apparatuses 10 and 11, and a hearing aid 51. The hearing-aid system does not perform relay using a relay device, and is different from the hearing-aid system in Embodiment 1 in that the hearing aid 51 and the AV apparatuses 10 and 11 therein directly communicate with each other. The same structural elements as in Embodiment 1 are assigned with the same reference signs, and the descriptions thereof are not repeated.

Figure 10:
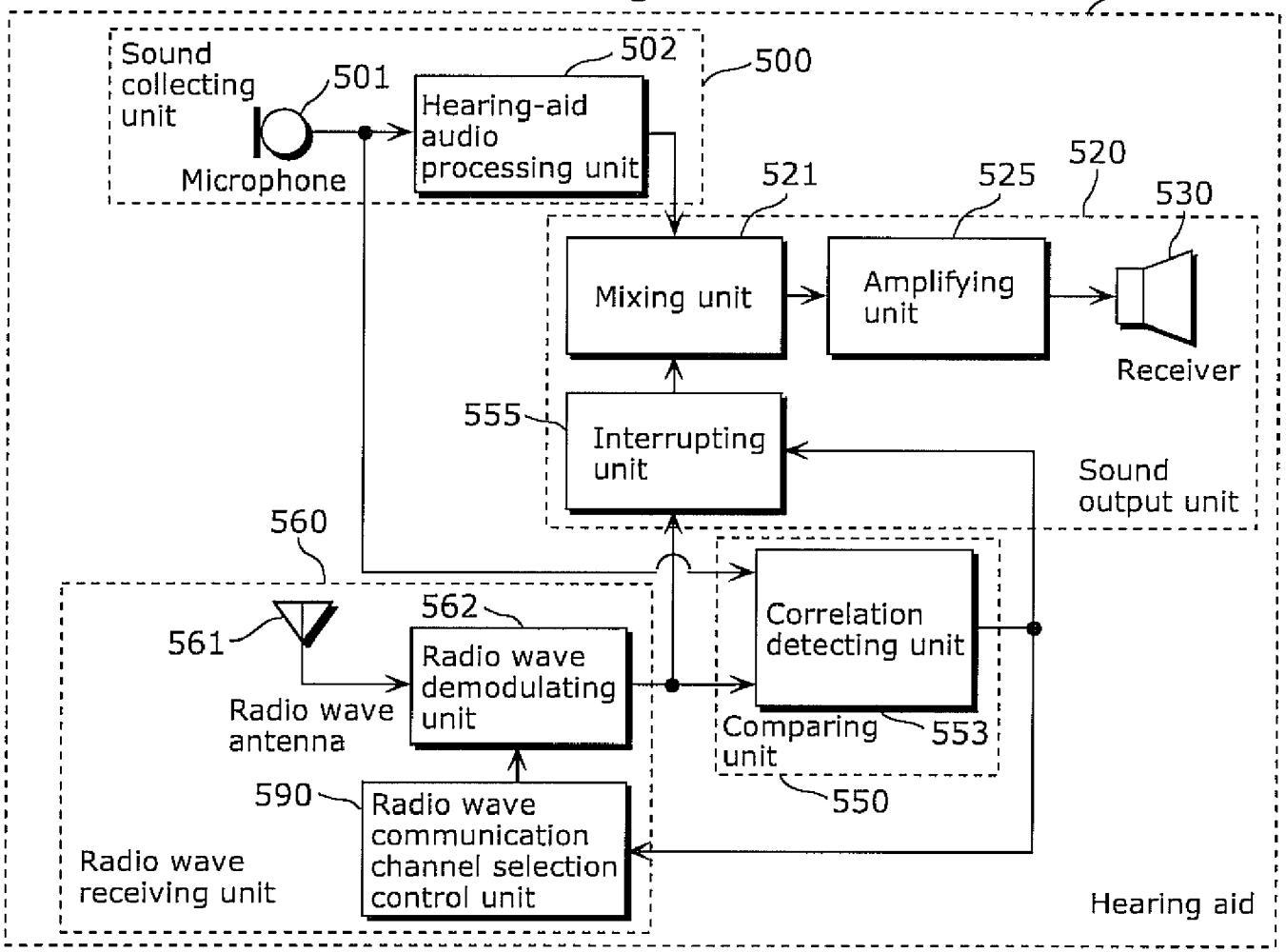
FIG. 10 is a functional block diagram of a hearing aid in Embodiment 2.

A description is given of a structure of the hearing aid 51 with reference to FIG. 10 that is a functional block diagram of the hearing aid 51. The hearing aid 51 includes a sound collecting unit 500, a radio wave receiving unit 560 that is a receiving unit, a comparing unit 550, and a sound output unit 520. The sound collecting unit 500 includes a microphone 501 and a hearing-aid audio processing unit 502, as in the hearing aid 50.

The radio wave receiver 560 includes a radio wave antenna 561, a radio wave demodulating unit 562, and a radio wave communication channel selection control unit 590. The radio wave antenna 561 receives a radio wave transmission audio signal transmitted from the AV apparatuses 10 and 11. The radio wave demodulating unit 562 demodulates the radio wave transmission audio signal received by the radio wave antenna 561, and outputs the demodulated audio signal to the comparing unit 550 and an interrupting unit 555. The radio wave communication channel selection control unit 590 specifies a frequency band that should be received, and thereby causing the radio wave antenna 561 and the radio wave demodulating unit 562 to receive the radio wave transmission audio signal having a particular frequency band. More specifically, the radio wave communication channel selection control unit 590 switches frequency bands that should be received, and thereby enables sequential reception of radio wave transmission audio signals output from the AV apparatuses 10 and 11.

The comparing unit 550 shown in FIG. 10 includes a correlation detecting unit 553 configured to detect a correlation between a waveform of the propagation sound collected by the microphone 501 and a waveform of the audio signal obtained from each of the radio wave transmission audio signals received by the radio wave receiving unit 560, and select, from among the radio wave transmission audio signals, a radio wave transmission audio signal having a correlation value exceeding a predetermined threshold value, in the same manner as performed by the comparing unit 420 in the relay device 40 in Embodiment 1. Alternatively, the correlation detecting unit 553 may select the radio wave transmission audio signal that has the highest correlation value with the propagation sound from among the radio wave transmission audio signals. The specific structure of the correlation detecting unit 553 is the same as that of the correlation detecting unit 423 shown in FIG. 3, and the descriptions thereof are not repeated.

The sound output unit 520 includes an interrupting unit 555, in addition to a mixing unit 521, an amplifying unit 525, and a receiver 530. The interrupting unit 555 controls whether or not an audio signal obtained by the radio wave receiving unit 560 should be output to the mixing unit 521. A typical example of the interrupting unit 555 is a switch.

Next, operations performed by the hearing aid 51 are described in detail. The following descriptions are given assuming that, as shown in FIG. 9, the two AV apparatuses 10 and 11 are placed at spatially distant positions (for example, in different rooms divided by a wall), and the AV apparatuses 10 and 11 includes speakers 20 and 21, and radio wave transmitters 30 and 31, respectively. In this case, when the user wearing the hearing aid 51 is near the AV apparatus 10, the hearing aid 51 collects, through the microphone 501, a propagation sound from the speaker 20, and receives, through the radio wave antenna 561, (i) the radio wave transmission audio signal from the radio wave transmitter 30 and (ii) the radio wave transmission audio signal from the radio wave transmitter 31.

When the radio wave receiving unit 560 of the hearing aid 51 receives radio wave transmission audio signals from the radio wave transmitters 30 and 31, the processing proceeds to the process of determining the audio visual apparatus as the connection source. First, the radio wave communication channel selection control unit 590 transmits a control signal to the radio wave demodulating unit 562 to cause the radio wave demodulating unit 562 to sequentially output the received radio wave transmission audio signals as described in Embodiment 1. In response to this, the radio wave demodulating unit 562 demodulates the radio wave transmission audio signals, and outputs the demodulated audio signals to the correlation detecting unit 553. The correlation detecting unit 553 detects a correlation between the propagation sound collected by the microphone 501 and the audio signal demodulated by the radio wave demodulating unit 562. This correlation detection and determination on presence or absence of correlation may be performed as in Embodiment 1.

When determining that there is a significant correlation, the correlation detecting unit 553 outputs information about the determination result to the interrupting unit 555. The interrupting unit 555 transits to a connection status. This connection status refers to a status in which an audio signal demodulated by the radio wave demodulating unit 562 is being output to the mixing unit 521.

In contrast, when determining that there is no significant correlation, the correlation detecting unit 553 outputs information about the determination result to the interrupting unit 555 and the radio wave communication channel selection control unit 590. The interrupting unit 555 transits to a disconnection status. This disconnection status refers to a status in which no audio signal demodulated by the radio demodulating unit 562 is output to the mixing unit 521.

When the radio wave antenna 561 is receiving a next radio wave transmission audio signal, the radio wave communication channel selection control unit 590 transmits a control signal to the radio wave demodulating unit 562 to cause the radio wave demodulating unit 562 to output the demodulated audio signal, in a similar manner as the relay device 40 according to Embodiment 1. The radio wave demodulating unit 562 demodulates the next radio wave transmission audio signal based on this control signal, and outputs the demodulated audio signal to the interrupting unit 555 and the correlation detecting unit 553, in the approximately same manner as the relay device 40.

The radio wave communication channel selection control unit 590 completes the connection destination determination when the radio wave antenna 561 does not receive any radio wave transmission audio signal. In this case, a disconnection status is established because no information about detection of presence of a significant correlation is transmitted from the correlation detecting unit 553 to the interrupting unit 555. Detection of presence or absence of a radio wave transmission audio signal receivable by the radio wave antenna 561 and connection destination determination are performed in units of a predetermined time period as in Embodiment 1.

In the manner as described above, the interrupting unit 555 controls whether or not the demodulated audio signal should be output to the mixing unit 521. Next, the mixing unit 521 mixes and adjusts the propagation sound collected by the microphone 501 and the audio signal obtained by the radio wave receiving unit 560. The mixing and adjustment may be performed as described in Embodiment 1.

In the aforementioned exemplary status, the user wearing the hearing aid 51 listens to a sound transmitted by radio wave transmission from the AV apparatus 10 near the user.

Next, when the user wearing the hearing aid 51 moves to the proximity of the AV apparatus 11, the output from the speaker 21 connected to the AV apparatus 11 becomes dominant in the sound wave reaching the microphone 501 of the hearing aid 51. In this status, it is impossible to detect a correlation between the sound wave collected by the microphone 501 and the radio wave transmission audio signal from the radio wave transmitter 30. When no correlation can be detected, the interrupting unit 555 enters into a disconnection status. When the sound from the speaker 21 becomes dominant in the sound wave that is collected by the microphone 501 by the aforementioned connection destination determination, the sound included in the radio wave transmission audio signal from the radio wave transmitter 31 is output from the receiver 530.

With this structure, the output from the receiver 530 of the hearing aid 51 is switched, which allows the user who is near the AV apparatus 11 after the movement, to listen to the sound of the audio signal from the AV apparatus 11. In addition, in this switching, the interrupting unit 555 enters into a disconnection status, and the audio signal obtained by performing audio processing on the propagation sound received by the microphone 501 is output from the receiver 530. The hearing-aid audio processing unit 502 performs appropriate audio processing, which makes it possible to control the switching such that the output of a sound from the receiver 530 does not suddenly stop and does not cause the user to feel great discomfort due to the sudden stoppage.

As in Embodiment 1, the hearing-aid system in Embodiment 2 also produces the same advantageous effect even when the AV apparatuses 10 and 11 are placed in a place without any object that blocks a sound wave propagating in the air.

Although the hearing aid 51 in the hearing-aid system in Embodiment 2 requires larger circuit scale and power consumption than those for the hearing aid 50, the hearing-aid system in Embodiment 2 allows the user wearing the hearing aid 51 to easily listen to the sounds from the AV apparatuses 10 and 11 by only approaching to the AV apparatuses 10 and 11 without performing any special operation. The hearing-aid system does not require a relay device, and thereby further increasing userfriendliness.

A case of using two audio visual apparatuses is described in Embodiment 2, but the number of audio visual apparatuses is not limited thereto. An arbitrary number, which corresponds to 1 or a greater number, of audio visual apparatuses may be applicable as a matter of course. The hearing aid 51 in the hearing-aid system in Embodiment 2 produces an advantageous effect of eliminating a connection operation even in the case of a single audio visual apparatus, and thereby increases userfriendliness for the user of the hearing aid, as in Embodiment 1.

In addition, examples of the AV apparatuses 10 and 11 include television sets, video devices, radio sets, stereo devices, theater devices, personal computers, and guidance announcement devices, as in Embodiment 1. Signal lines use to connect the AV apparatuses 10 and 11 and the radio wave transmitters 30 and 31 are, for example, analog line signals, optical digital signals, co-axial digital signals, and HDMI-support digital signals, as in Embodiment 1. In addition, the speakers 20 and 21 and the radio wave transmitters 30 and 31 may be embedded in the bodies of the AV apparatuses 10 and 11, respectively. In this case, it is possible to set the system more easily.

Embodiment 2 has been described taking radio wave transmission as an example, but inter-apparatus transmission schemes are not limited thereto. It is possible to use arbitrary schemes by using radio waves, magnetic fields, infrared rays, visible light, and supersonic waves.

In the connection destination processing taken as an example in the above description, a correlation is calculated while sequentially switching radio wave transmission audio signals. However, it is also good to detect the correlations with all the radio wave transmission audio signals first and then select the radio wave transmission audio signal that yields the largest correlation value. In addition, in the case where two or more radio wave transmission audio signals having approximately the same correlation values are found, it is possible to add a process of, for example, selecting the radio wave transmission audio signal having the greatest signal strength, according to the signal strengths of the respective radio wave transmission audio signals. In this way, it is possible to determine a connection destination more securely.

Variation of Embodiment 2

Figure 11:
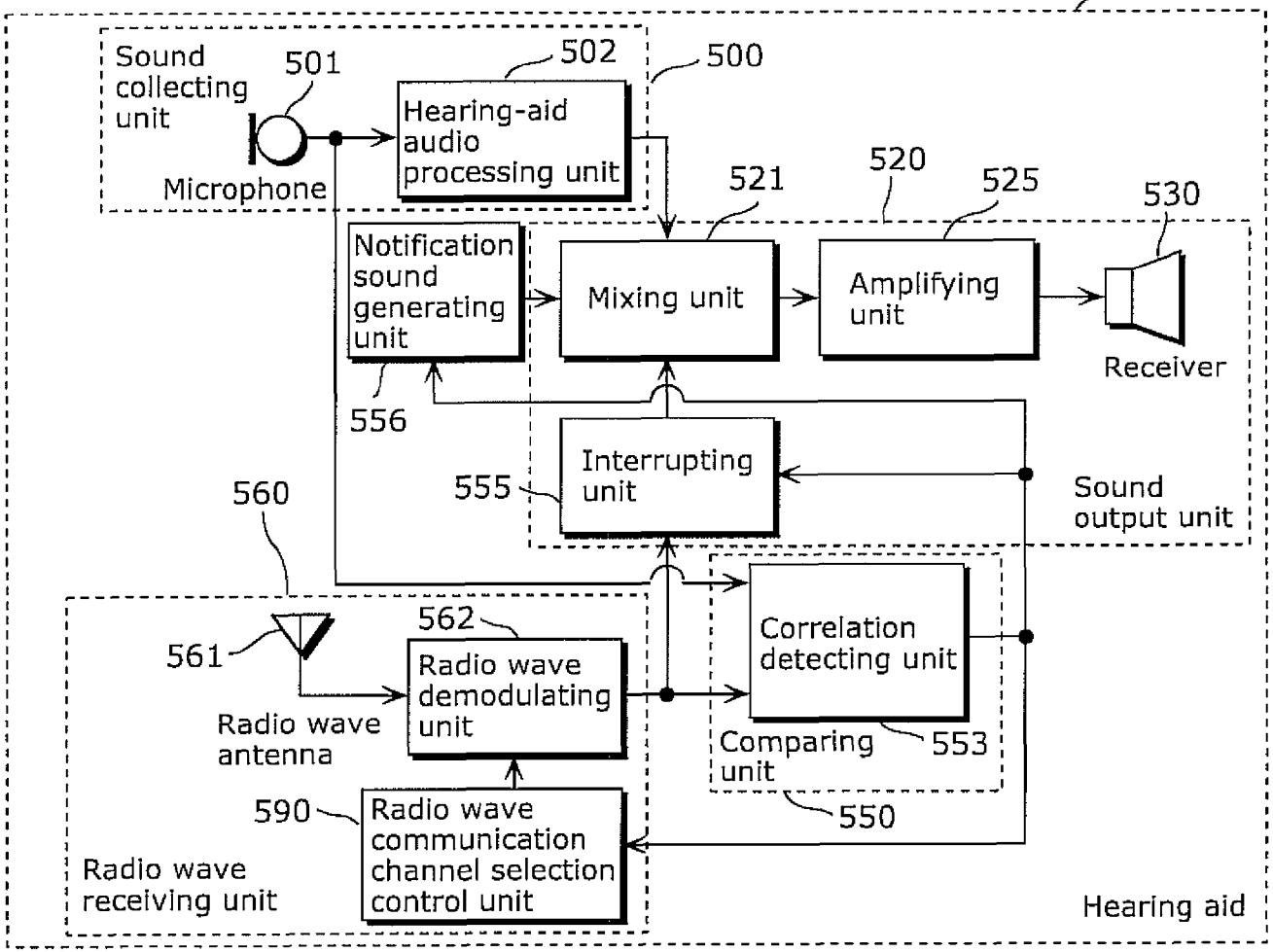
FIG. 11 is a functional block diagram of a hearing aid in a variation of Embodiment 2.

Next, a description is given of a hearing aid 51 according to a variation of Embodiment 2 with reference to FIG. 11. The same structural elements as in Embodiment 2 are assigned with the same reference signs, and the descriptions thereof are not repeated. In the hearing aid according to this variation of Embodiment 2, the sound collecting unit collects a compound propagation sound including a propagation sound and a sound produced around a user. The sound output unit therein includes a mixing unit configured to mix, at a predetermined ratio, a compound propagation sound collected by the sound collecting unit and the sound obtained from the transmission audio signal selected by the comparing unit, and an amplifying unit configured to amplify the sound mixed by the mixing unit and outputs the amplified sound to the user. The hearing aid further includes a notifying unit configured to notify the user of completion of mixing, by the mixing unit, of the compound propagation sound and the sound obtained from the transmission audio signal.

The hearing aid 51 shown in FIG. 11 further includes a notification sound generating unit 556 that is a notifying unit, in addition to the structural elements of the hearing aid 51 shown in FIG. 10. The notification sound generating unit 556 is intended to notify the user of the completion of mixing, by the mixing unit 521, of the audio signal output from the hearing-aid audio processing unit 502 and the audio signal output from the radio wave demodulating unit 562. In other words, the notification sound generating unit 556 notifies the user that the interrupting unit 555 is now in a connection status.

More specifically, the notification sound generating unit 556 outputs, to the mixing unit 521, a notification sound such as "output of radio wave transmission signal is started" at timing when the interrupting unit 555 is switched into a connection status. The mixing unit 521 mixes the audio signal output from the hearing-aid audio processing unit 502, the audio signal output from the radio wave demodulating unit 562, and the notification sound output from the notification sound generating unit 556, and outputs the mixed audio signal to the amplifying unit 525. In addition, it is possible to output, to the mixing unit 521, a notification sound such as "output of radio wave transmission signal is completed" at timing when the interrupting unit 555 is switched into a disconnection status.

Embodiment 3

Figure 12:
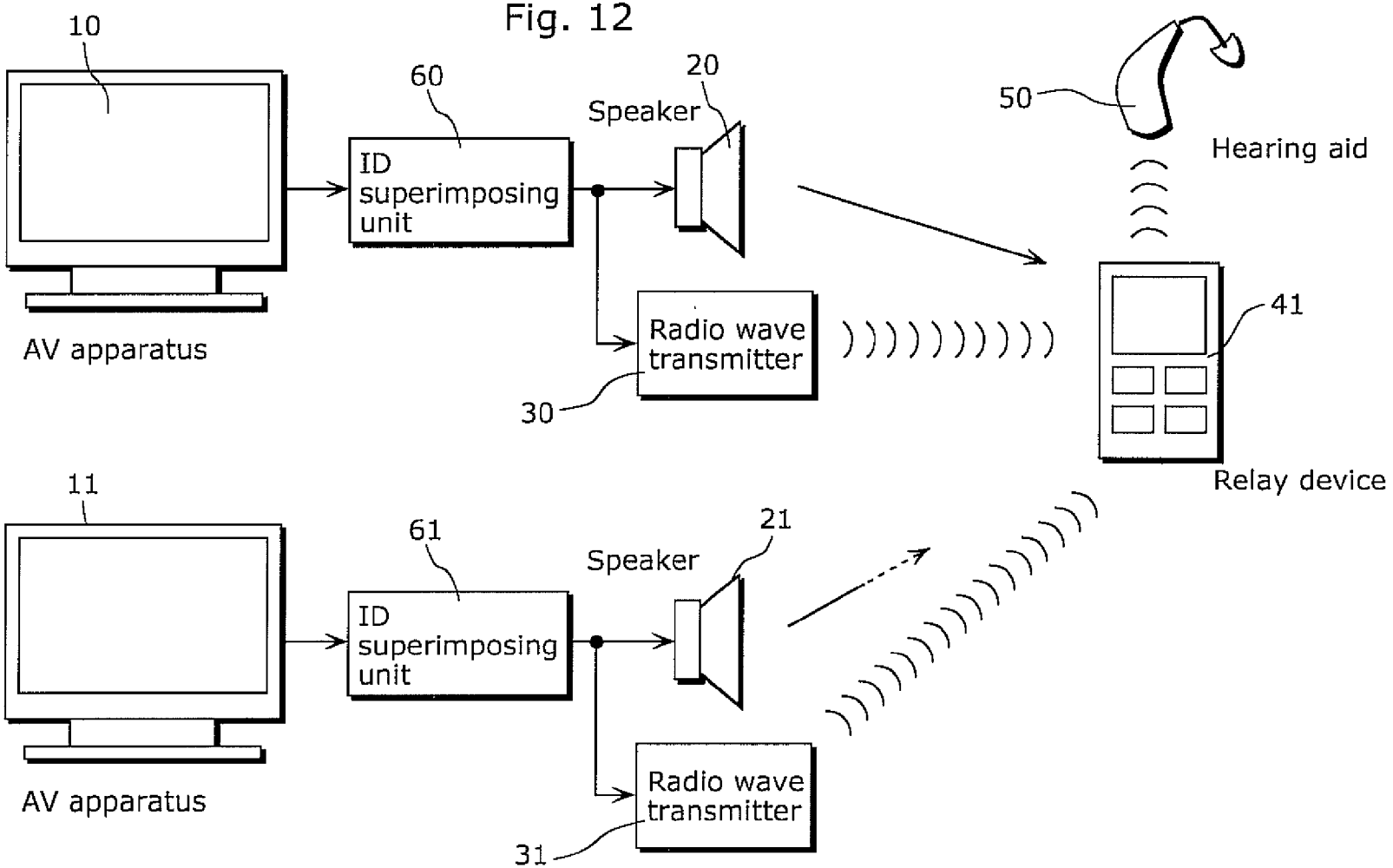
FIG. 12 is a structural diagram of a hearing-aid system in Embodiment 3.

With reference to FIG. 12, a description is given of a structure of a hearing-aid system according to Embodiment 3 of the present invention. The hearing-aid system in Embodiment 3 includes AV apparatuses 10 and 11, a relay device 41, and a hearing aid 50. The hearing-aid system is different from the hearing-aid system in Embodiment 1 in that ID superimposing units 60 and 61 are connected to the AV apparatuses 10 and 11, respectively. The same structural elements as in Embodiment 1 are assigned with the same reference signs, and the descriptions thereof are not repeated.

Each of the ID superimposing units 60 and 61 is connected to a corresponding one of the AV apparatuses 10 and 11, and superimposes an ID signal that is a unique identification signal to an audio signal from the corresponding one of the AV apparatuses 10 and 11. An ID signal is, for example, a tone signal using an audible sound, a pilot signal using a non-audible sound, a watermark signal, or the like. The ID signal is a signal associated with the AV apparatus 10 or 11 connected to an ID superimposing unit 60 or 61, and more specifically, is for identifying the associated AV apparatus 10 or 11.

Each of the ID superimposing units 60 and 61 superimposes the ID signal associated with the AV apparatus 10 or 11 on an audio signal to be output from the AV apparatus 10 or 11. A propagation sound on which the ID signal is superimposed is amplified and output by the speaker 20 or 21 and propagates in the air, and at the same time, an audio signal on which the ID signal is superimposed is modulated into a radio wave transmission audio signal and transmitted by the radio wave transmitter 30 or 31.

Figure 13:
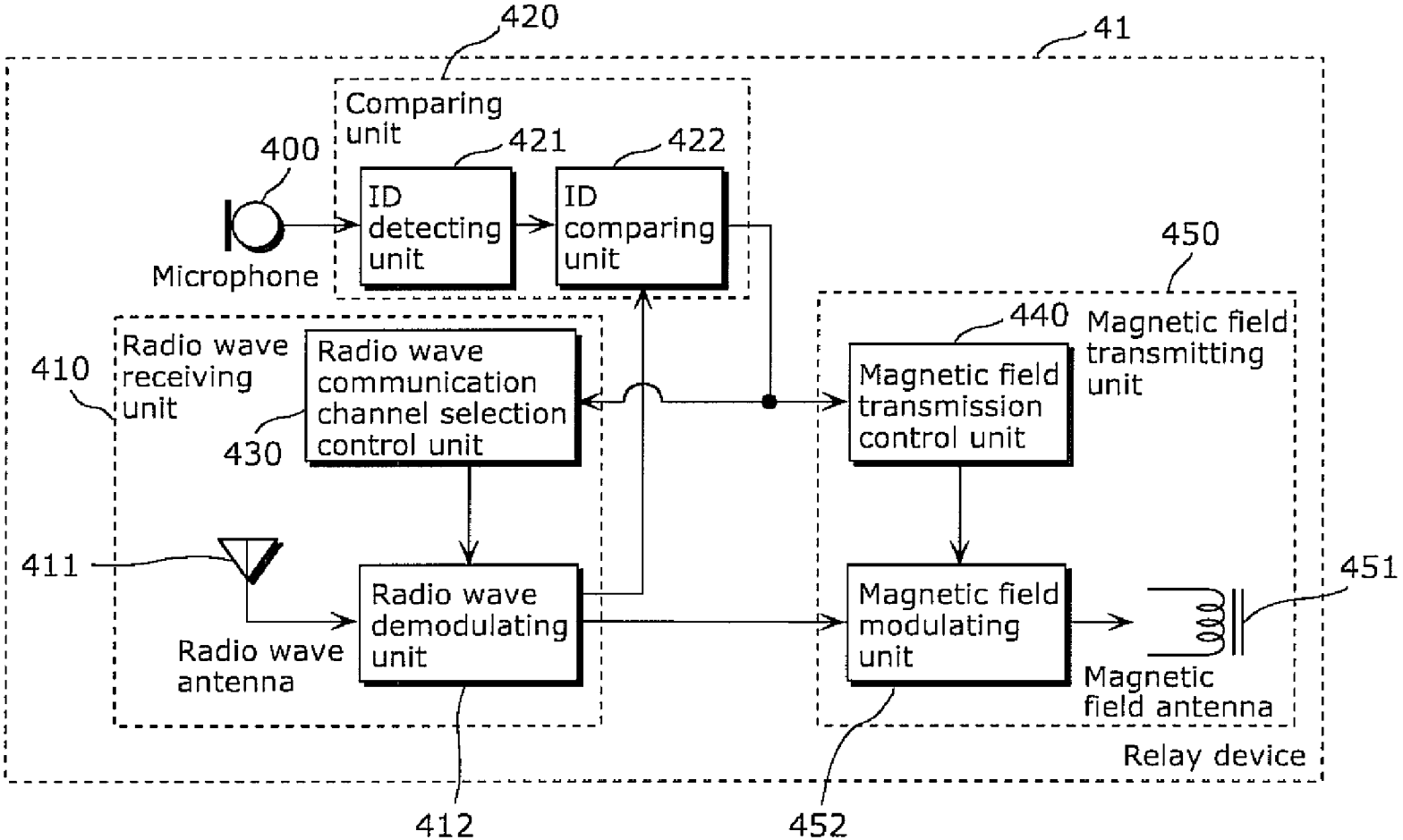
FIG. 13 is a functional block diagram of a relay device in Embodiment 3.

Next, a description is given of a structure of the relay device 41 with reference to FIG. 13 that is a functional block diagram of the relay device 41. The relay device 41 shown in FIG. 13 is different from the relay device 41 shown in FIG. 2 in the structure of the comparing unit 420. More specifically, the comparing unit 420 shown in FIG. 13 includes an ID detecting unit 421 configured to detect an ID signal superimposed on a propagation sound collected by the microphone 400, and an ID comparing unit 422 that is a comparing unit configured to compare the ID signal superimposed on the propagation sound and the ID signal superimposed on the radio wave transmission audio signal. More specifically, the comparing unit 420 of the relay device 41 is different from the comparing unit 420 in the relay device 40 according to Embodiment 1 in that the comparing unit 420 includes an ID detecting unit 421 and an ID comparing unit 422 and does not include a correlation detecting unit 423.

The ID detecting unit 421 is connected to the microphone 400, and extracts the ID signal from the propagation sound collected by the microphone 400. The ID comparing unit 422 compares the ID signal extracted by the ID detecting unit 421 and the ID signal extracted from the audio signal demodulated by the radio wave demodulating unit 412, and determines whether or not these ID signals match each other.

As shown in FIG. 12, when a user wearing the hearing aid 50 and holding the relay device 41 is near the AV apparatus 10, the relay device 41 receives the propagation sound from the speaker 20, the radio wave transmission audio signal from the radio wave transmitter 30, and the radio wave transmission audio signal from the radio wave transmitter 31. When the relay device 41 receives the radio wave transmission audio signals from the radio wave transmitters 30 and 31, the processing proceeds to a process of determining a connection source for relay.

Figure 14:
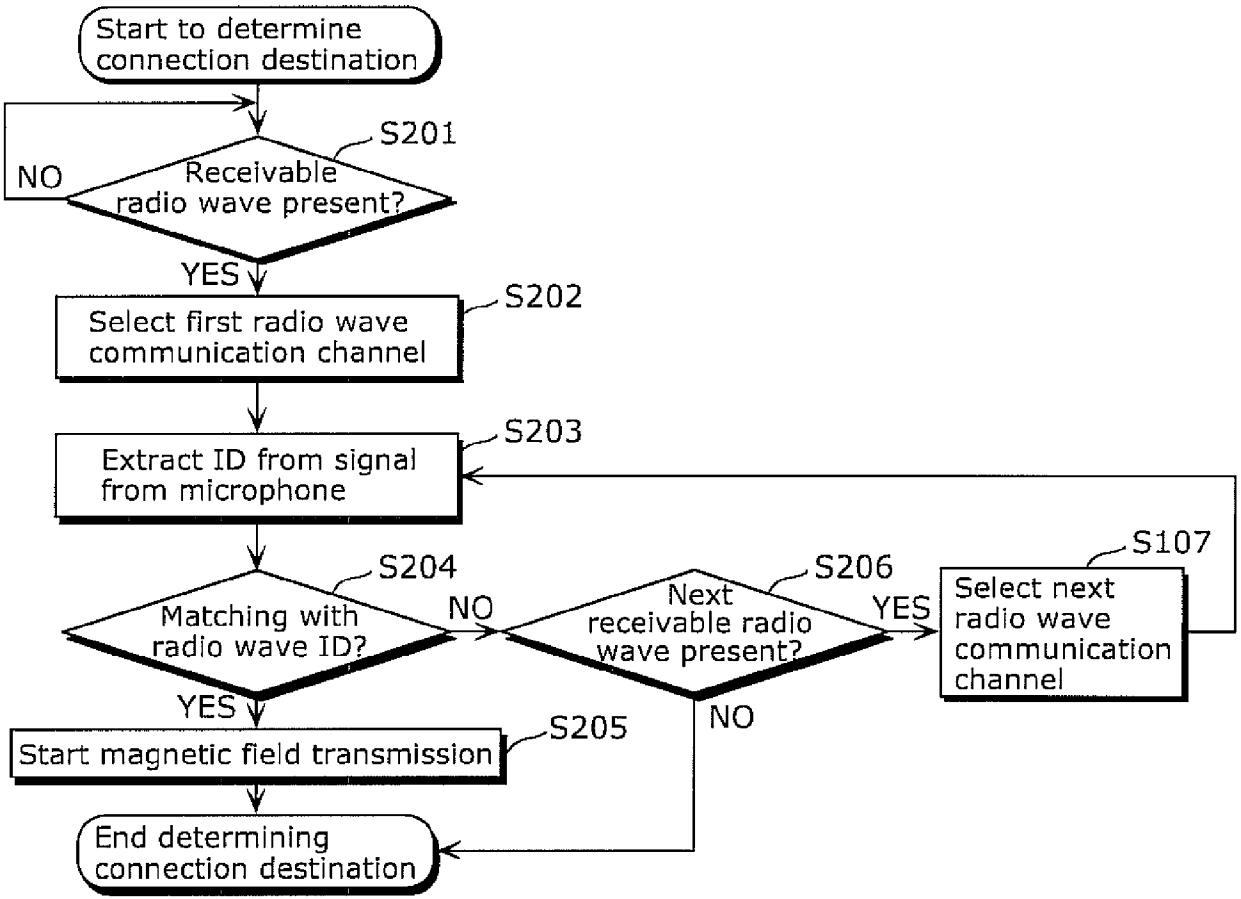
FIG. 14 is a flowchart of connection destination determination processing in Embodiment 3.
Figure 15:
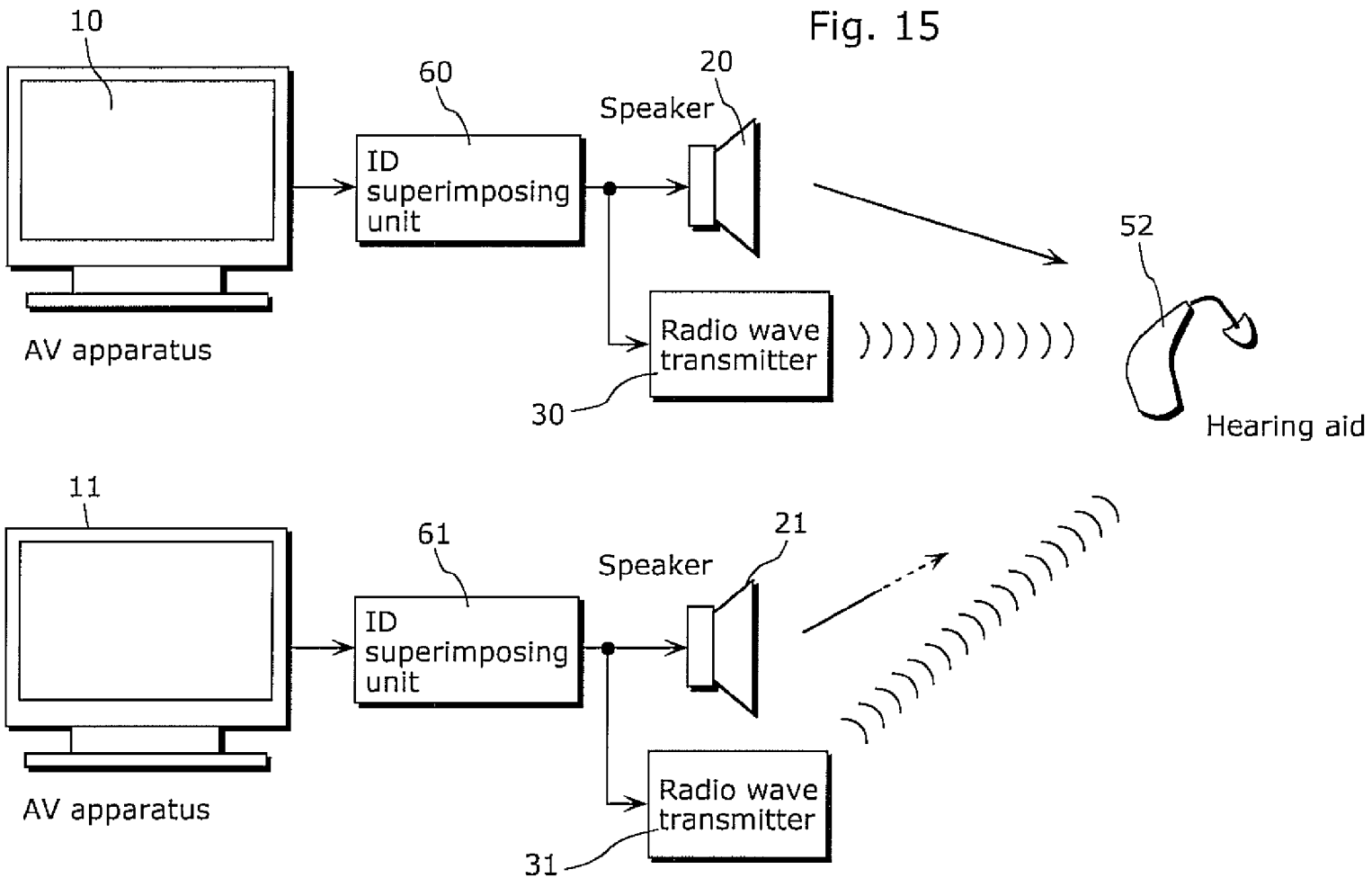
FIG. 15 is a structural diagram of another hearing-aid system in Embodiment 3.

This connection destination determination process executed by the relay device 41 is partly different from the connection destination determination process executed by the relay device 40 according to Embodiment 1, and thus a description is given with reference to FIG. 14.

First, when radio wave transmission audio signals are received by the radio wave antenna 411 (YES in Step S201), the radio wave communication channel selection control unit 430 transmits a control signal to the radio wave demodulating unit 412 to cause the radio wave demodulating unit 412 to sequentially output the received radio wave transmission audio signals. The radio wave demodulating unit 412 demodulates the radio wave transmission audio signal according to this control signal, and extracts an ID signal from the demodulated audio signal. Next, the radio wave demodulating unit 412 outputs the audio signal to the magnetic field modulating unit 452, and outputs the ID signal to the ID comparing unit 422 (Step S202).

Meanwhile, the ID detecting unit 421 extracts the ID signal superimposed on the propagation sound collected by the microphone 400 (Step S203). The ID signal demodulated by the radio wave demodulating unit 412 and the ID signal extracted by the ID detecting unit 421 are input to the ID comparing unit 422, and whether or not these ID signals match each other is determined (Step S204).

When determining that these ID signals match each other (YES in Step S204), the ID comparing unit 422 outputs information about the determination result to the magnetic field transmission control unit 440, and transmits a control signal to the magnetic field demodulating unit 542 to cause the magnetic field modulating unit 542 to perform magnetic field transmission. According to the control signal, the magnetic field modulating unit 542 modulates an audio signal output from the radio wave demodulating unit 412, and outputs, to the magnetic field antenna 451, the magnetic field transmission audio signal obtained through the demodulation (Step S205).

In contrast, when determining that these ID signals do not match each other (NO in Step S204), the ID comparing unit 422 outputs information about the determination result to the radio wave communication channel selection control unit 430. Upon reception of the determination result, the radio wave communication channel selection control unit 430 transmits a control signal to the radio wave antenna 411 and the radio wave demodulating unit 412 to cause output of an audio signal corresponding to a next radio wave transmission audio signal. When the radio wave transmission audio signal that should be output next is already received by the radio wave antenna 411 (YES in Step S206), the radio wave demodulating unit 412 of the radio wave receiving unit 410 demodulates the audio signal and the ID signal from the next radio wave transmission audio signal, and outputs the audio signal and the ID signal to the magnetic field modulating unit 452 and the ID comparing unit 422, respectively (Step S207).

The same processes are repeated hereinafter. When no radio wave transmission audio signal that should be output next is received by the radio wave antenna 411 (NO in Step S206), the radio wave demodulating unit 412 completes the connection destination determination processing.

With this structure, the relay device 41 is capable of relaying an audio signal from the nearby AV apparatus 10 to the hearing aid 50, in the same manner as performed by the relay device 40 in Embodiment 1. Thus, this hearing-aid system is also capable of facilitating listening to an audio signal from the AV apparatus 10 near the user wearing the hearing aid 50, in the same manner as performed by the hearing-aid system in Embodiment 1.

Furthermore, even when the user wearing the hearing aid 50 and holding the relay device 41 moves and thereby the positional relationships between the user and the respective AV apparatuses 10 and 11 change, this hearing-aid system is capable of switching output from the receiver 530 as in Embodiment 1. How to switch the output is described below.

When the positional relationships between the user and the respective AV apparatuses 10 and 11 change, the ID comparing unit 422 detects a mismatch between the ID signal superimposed on the propagation sound and the ID signal superimposed on the radio wave transmission audio signal. In this case, the magnetic field transmission is temporarily stopped, and a new radio wave transmission audio signal having a matching ID signal is selected by connection destination determination processing shown in FIG. 14. In this way, it is possible to enable the user to listen to a sound from the AV apparatus 11 without any special operation when the user moves from the proximity of the AV apparatus 10 to the proximity of the AV apparatus 11. As in Embodiment 1, it is only necessary that the hearing aid 50 performs hearing-aid processing in this switching so that the user does not feel a great discomfort.

Compared with the hearing-aid system in Embodiment 1, this hearing-aid system is capable of detecting, based on the ID signal, the association between a propagation sound and a radio wave transmission audio signal in a more secure manner, and therefore this hearing-aid system malfunctions less frequently.

The hearing-aid system is also applicable to a case where an arbitrary number, which corresponds to 1 or a greater number, of audio visual apparatuses is present. In addition, examples of the AV apparatuses 10 and 11 include television sets, video devices, radio wave sets, stereo devices, theater devices, personal computers, and guidance announcement devices. Signal lines used to connect the AV apparatuses 10 and 11, the radio wave transmitters 30 and 31, and the ID superimposing units 60 and 61 are, for example, analog line signals, optical digital signals, co-axial digital signals, and HDMI-support digital signals. In addition, the speakers 20 and 21, the radio wave transmitters 30 and 31, and the ID superimposing units 60 and 61 may be embedded in the bodies of the AV apparatuses 10 and 11. In this case, it is possible to easily set the system.

In addition, although an example of combining radio wave transmission and magnetic field transmission is described in Embodiment 3, inter-apparatus transmission schemes are not limited thereto. It is possible to arbitrarily combine and use radio waves, magnetic fields, infrared rays, visible light, supersonic waves, wires, etc.

These ID signals to be transmitted by radio waves may be superimposed on modulated radio wave transmission audio signals, or may be coded and multiplexed as supplemental information separate from the radio wave transmission audio signals.

Although the hearing-aid system in the above description performs relay by the relay device 41, it is also good that the hearing-aid system is configured to allow direct communication between a hearing aid 52 and AV apparatuses 10 and 11 without relay by such a relay device. In this case, as shown in FIG. 16, the hearing aid 52 includes a sound collecting unit 500, a sound output unit 520, a radio wave receiving unit 560 that is a receiving unit, and a comparing unit 550 including an ID detecting unit 551 and an ID comparing unit 552.

Figure 16:
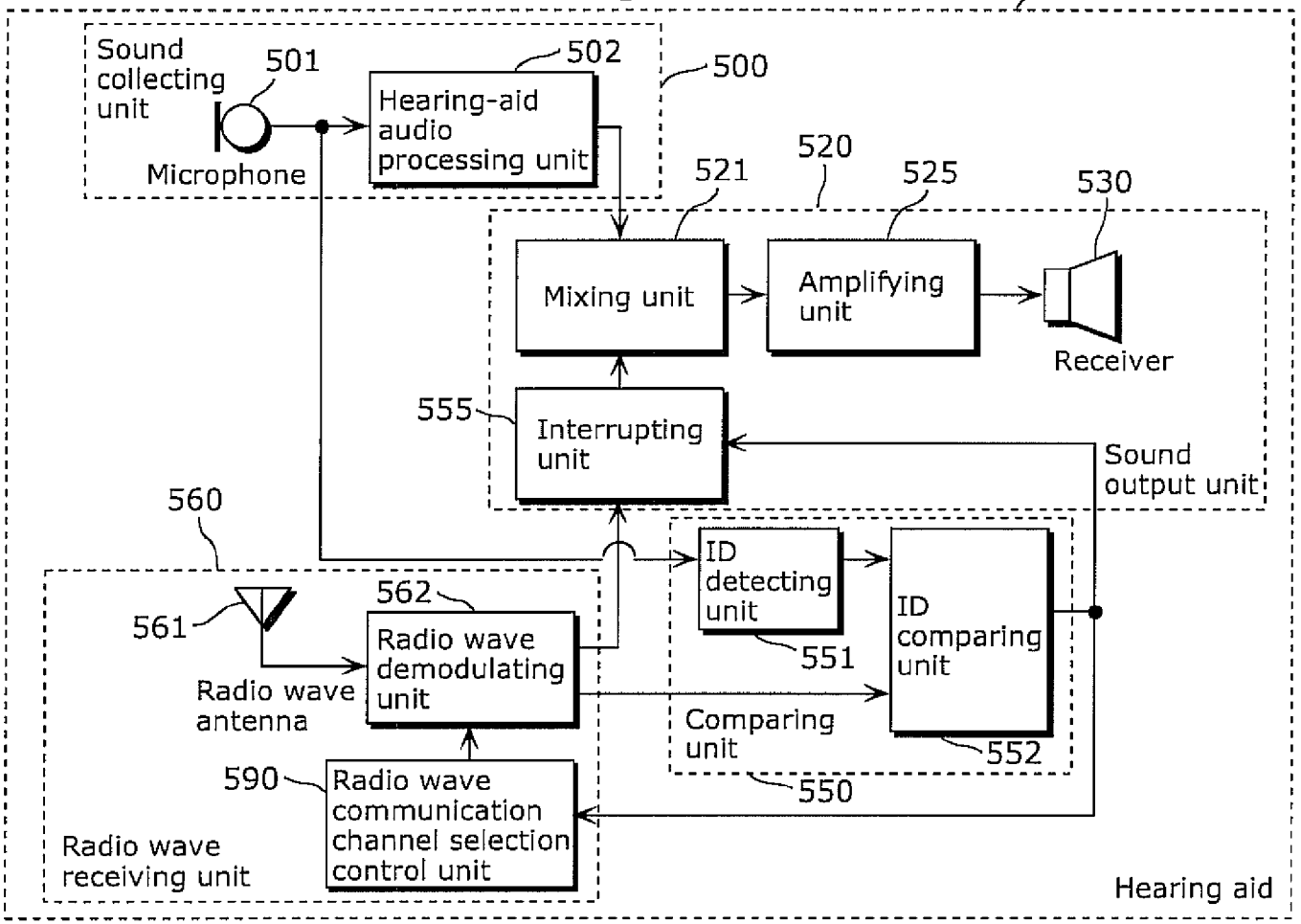
FIG. 16 is a functional block diagram of another hearing aid in Embodiment 3.

In the hearing aid 52 configured as shown in FIG. 16, the ID detecting unit 551 extracts an ID signal from the propagation sound collected by the microphone 501. Likewise, the radio wave demodulating unit 562 demodulates the radio wave transmission audio signal, and extracts the ID signal from the demodulated audio signal. The ID comparing unit 552 compares the ID signal extracted by the ID detecting unit 551 and the ID signal extracted by the radio wave demodulating unit 562 and determines whether or not these ID signals match each other. Operations performed by the respective structural elements are the same as described in Embodiments 2 and 3.

The hearing aid 52 having this structure without a relay device increases userfriendliness although the hearing aid 52 requires a circuit scale and a power consumption which are larger than those for the hearing aid 50.

Embodiment 4

A haring aid according to Embodiment 4 further includes: a delay amount calculating unit configured to calculate a delay time of the transmission audio signal with respect to the propagation sound, by comparing collecting timing of the propagation sound collected by the sound collecting unit with receiving timing, in the receiving unit, of the transmission audio signal selected by the comparing unit; and a transmitting unit configured to transmit, through the first transmission path, a control signal for causing the external apparatus which outputs the transmission audio signal selected by the comparing unit to output the propagation sound with a delay corresponding to the delay time calculated by the delay amount calculating unit.

Figure 17:
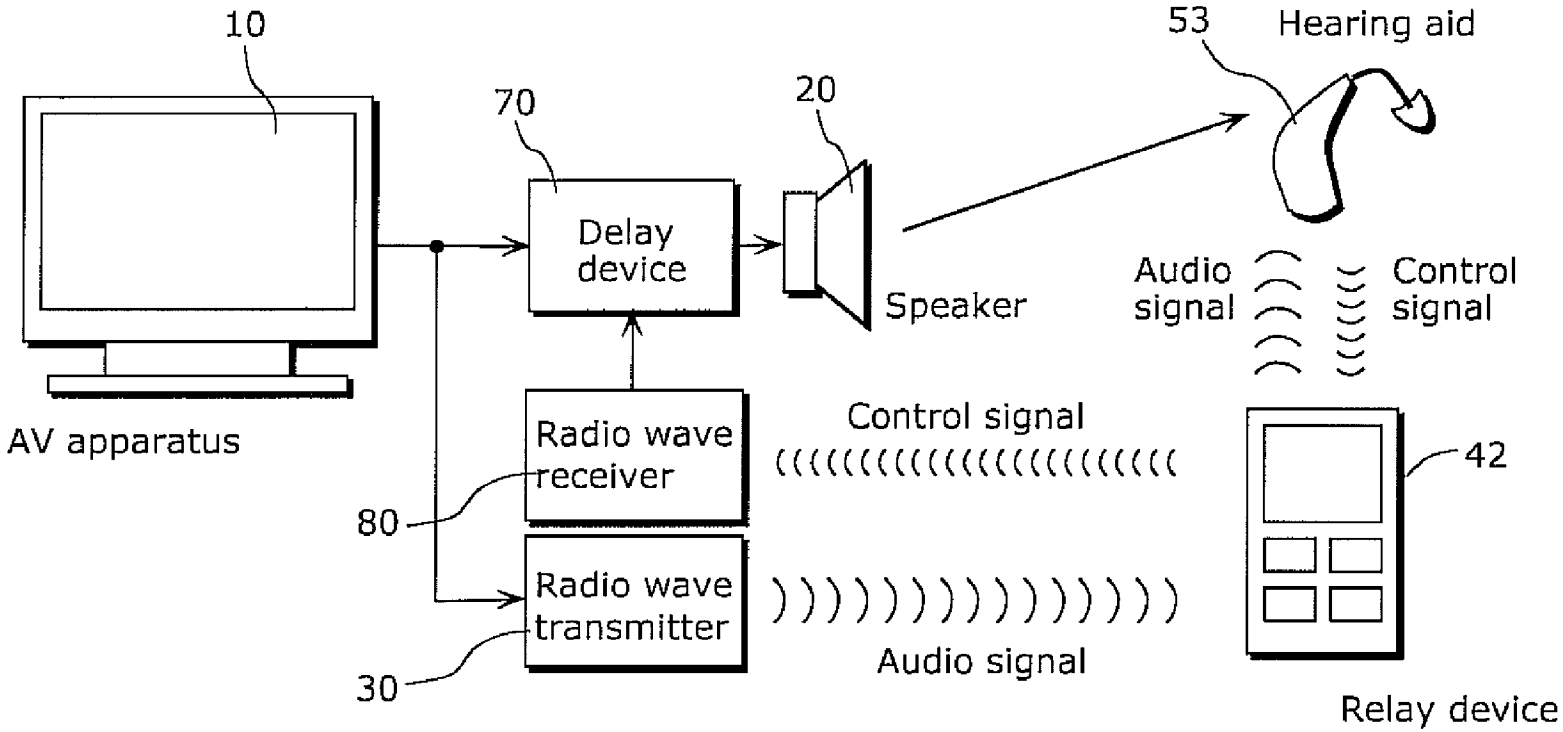
FIG. 17 is a structural diagram of a hearing-aid system in Embodiment 4.

With reference to FIG. 17, a description is given of a structure of a hearing-aid system according to Embodiment 4 of the present invention. The hearing-aid system in Embodiment 4 includes an AV apparatus 10, a relay device 42, and a hearing aid 53. In addition to the structural elements shown in FIG. 1, a delay device 70 and a radio wave receiver 80 are connected to the AV apparatus 10. To the delay device 70, a speaker 20 and a radio wave receiver 80 are connected. The radio wave receiver 80 receives a control signal for determining a delay amount for the delay device 70. The same structural elements as in Embodiments 1 to 3 are assigned with the same reference signs, and the descriptions thereof are not repeated.

Figure 18:
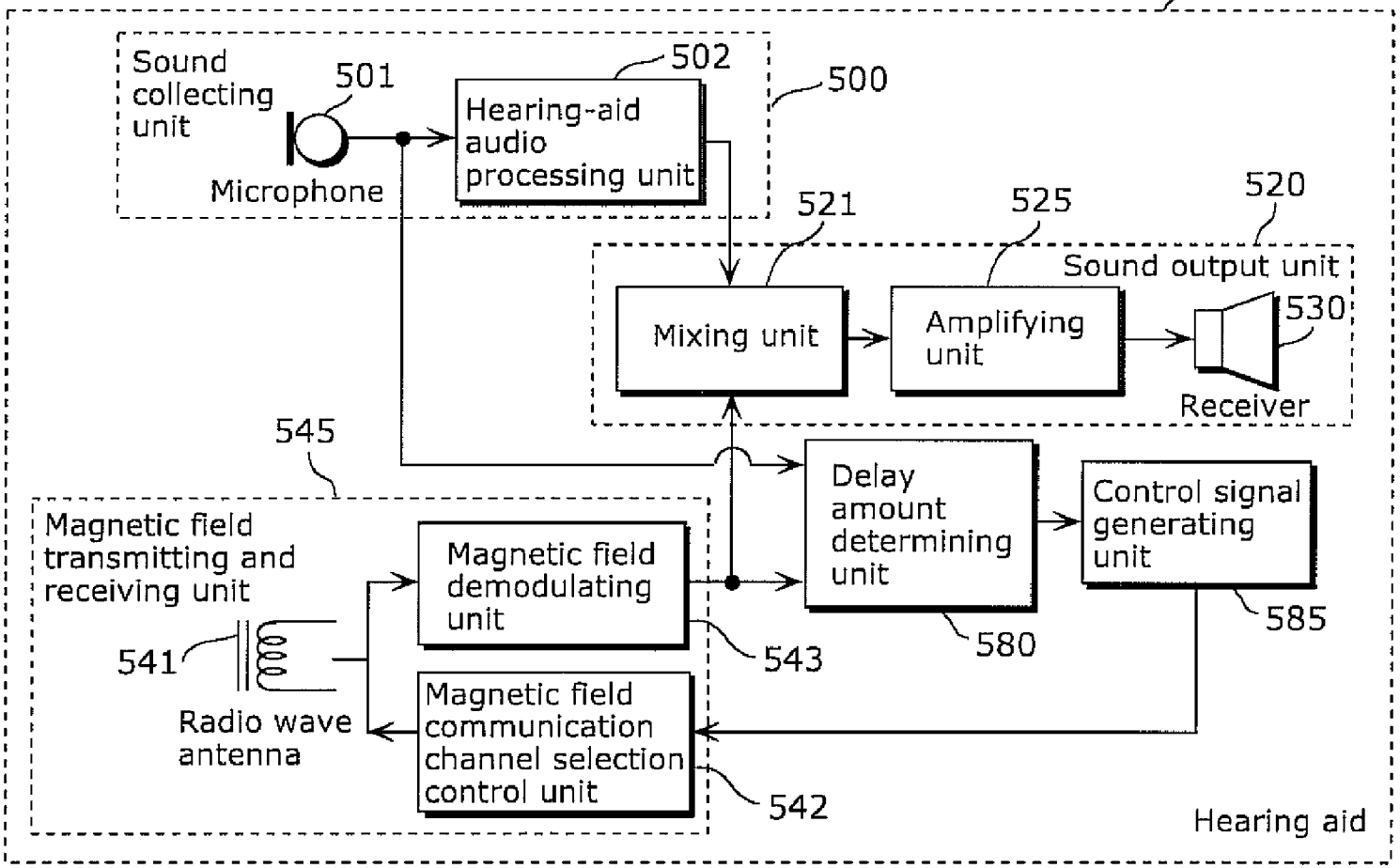
FIG. 18 is a functional block diagram of a hearing aid in Embodiment 4.

A description is given of a structure of the hearing aid 53 with reference to FIG. 18 that is a functional block diagram of the hearing aid 53. As with the hearing aids 50, 51, and 52, the hearing aid 53 includes a sound collecting unit 500 including a microphone 501 and a hearing-aid audio processing unit 502, and a sound output unit 520 including a mixing unit 521, an amplifying unit 525, and a receiver 530.

The hearing aid 53 further includes a magnetic field transmitting and receiving unit 545, a delay amount determining unit 580, and a control signal generating unit 585. The magnetic field transmitting and receiving unit 545 includes: a magnetic field antenna 541; a magnetic field modulating unit 542 configured to modulate a control signal generated by the control signal generating unit 585 and cause the magnetic field antenna 541 to transmit the modulated control signal; and a magnetic field demodulating unit 543 configured to demodulate the magnetic field transmission audio signal received by the magnetic field antenna 541 into an audio signal, and transmit the demodulated audio signal to the mixing unit 521 and the delay amount determining unit 580.

The delay amount determining unit 580 determines a time delay amount of the audio signal demodulated by the magnetic field demodulating unit 543 with respect to the propagation sound collected by the microphone 501. The control signal generating unit 585 generates a control signal according to the delay amount determined by the delay amount determining unit 580, and outputs the control signal to the magnetic field modulating unit 542.

Figure 19:
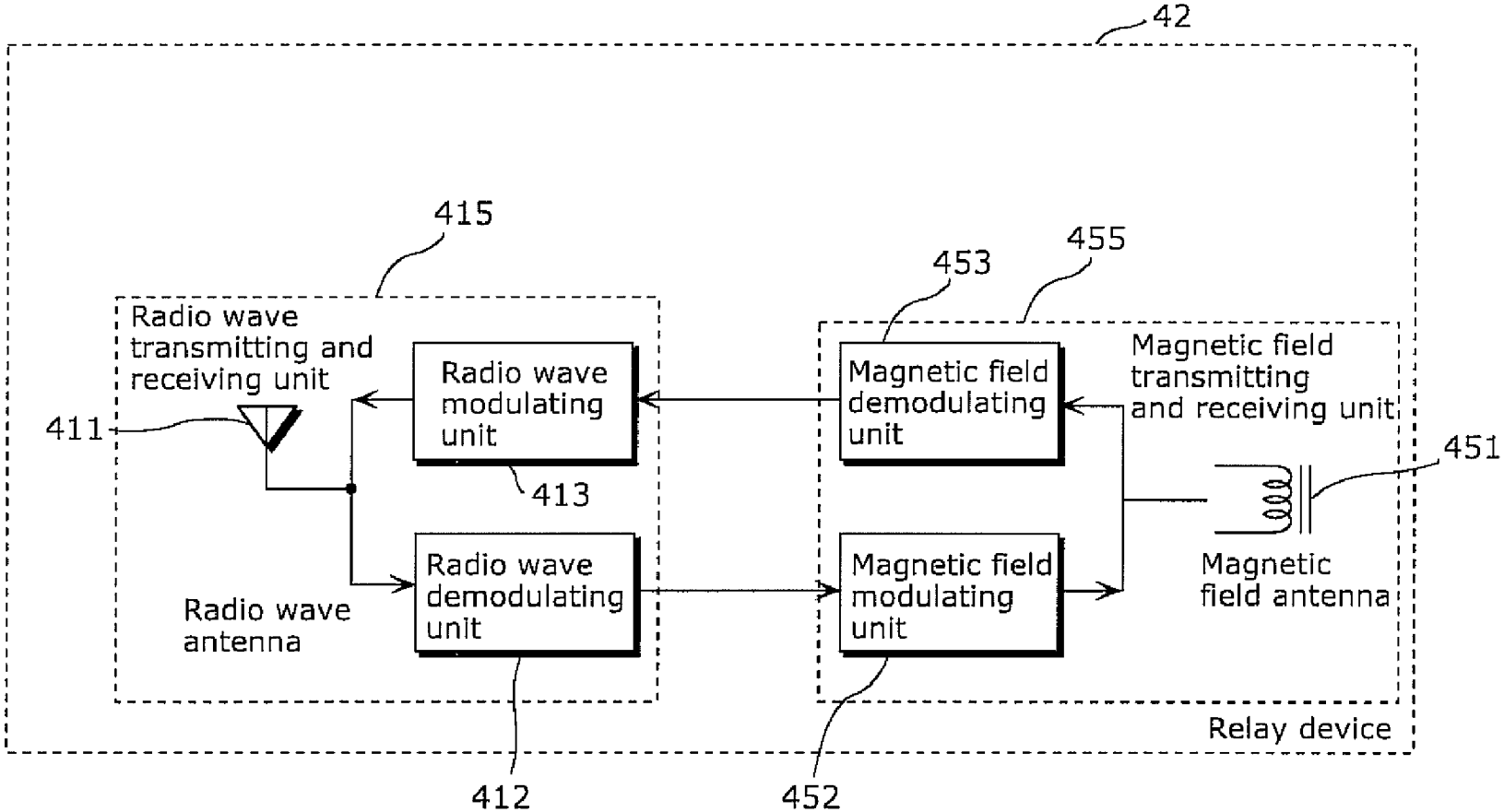
FIG. 19 is a functional block diagram of a relay device in Embodiment 4.

Next, a description is given of a structure of the relay device 42 with reference to FIG. 19 that is a functional block diagram of the relay device 42. The relay device 42 includes a radio wave transmitting and receiving unit 415 and a magnetic field transmitting and receiving unit 455.

The radio wave transmitting and receiving unit 415 includes: a radio wave antenna 411 which transmits a radio wave transmission audio signal and receives a radio wave transmission audio signal; a radio wave demodulating unit 412 configured to demodulate the radio wave transmission audio signal received by the radio wave antenna 411 into an audio signal, and output the demodulated audio signal to the magnetic field modulating unit 452; and a radio wave modulating unit 413 configured to modulate a control signal into a radio wave transmission control signal, and cause the radio wave antenna 411 to transmit the modulated control signal.

The magnetic field transmitting and receiving unit 455 includes: a magnetic field antenna 451 which transmits a magnetic field transmission audio signal and receives a magnetic field transmission audio signal; a magnetic field modulating unit 452 configured to modulate the audio signal demodulated by the radio wave demodulating unit 412 into a magnetic field transmission audio signal, and cause the magnetic field antenna 451 to transmit the modulated audio signal; and a magnetic field demodulating unit 453 configured to demodulate the magnetic field transmission control signal received by the magnetic field antenna 451 into a control signal, and output the demodulated control signal to the radio wave demodulating unit 453.

Operations performed by this hearing-aid system are described below with reference to FIG. 17 to FIG. 20. The audio signal from the AV apparatus 10 passes through the delay device 70 and is amplified and output as a propagation sound that propagates in the air. The initial value for the delay amount in the delay device 70 may be arbitrary, and for example, may be a zero delay. The propagation sound as a sound wave that is output from the speaker 20 is collected by the microphone 501 of the hearing aid 53, subjected to audio processing by the hearing-aid audio processing unit 502, and input to the mixing unit 521 and the delay amount determining unit 580.

The radio wave transmission audio signal from the AV apparatus 10 that is transmitted by a radio wave from the radio wave transmitter 30 is received by the radio wave antenna 411 of the relay device 42, demodulated by the radio wave demodulating unit 412, modulated by the magnetic field modulating unit 452 into a magnetic field transmission audio signal, and transmitted by a magnetic field by the magnetic field antenna 451. As with the relay device 40, the relay device 42 may be configured to include a microphone 400, a comparing unit 420 including a correlation detecting unit 423, a radio wave communication channel selection control unit 430, and a magnetic field transmission control unit 440, and select an audio signal to be transmitted by a magnetic field. Alternatively, as with the relay device 41, the relay device 42 may be configured to include a comparing unit 420 including an ID detecting unit 421 and an ID comparing unit 422 instead of a correlation detecting unit 423, and select an audio signal to be transmitted by a magnetic field.

The magnetic field transmission audio signal transmitted by a magnetic field from the relay device 42 is received by the magnetic field antenna 541 of the hearing aid 53, and demodulated by the magnetic field demodulating unit 543. The demodulated audio signal is output to the mixing unit 521, and at the same time, is input to the delay amount determining unit 580. The mixing unit 521, the amplifying unit 525, and the receiver 530 perform the same operations as in Embodiments 1 to 3.

Figure 20:
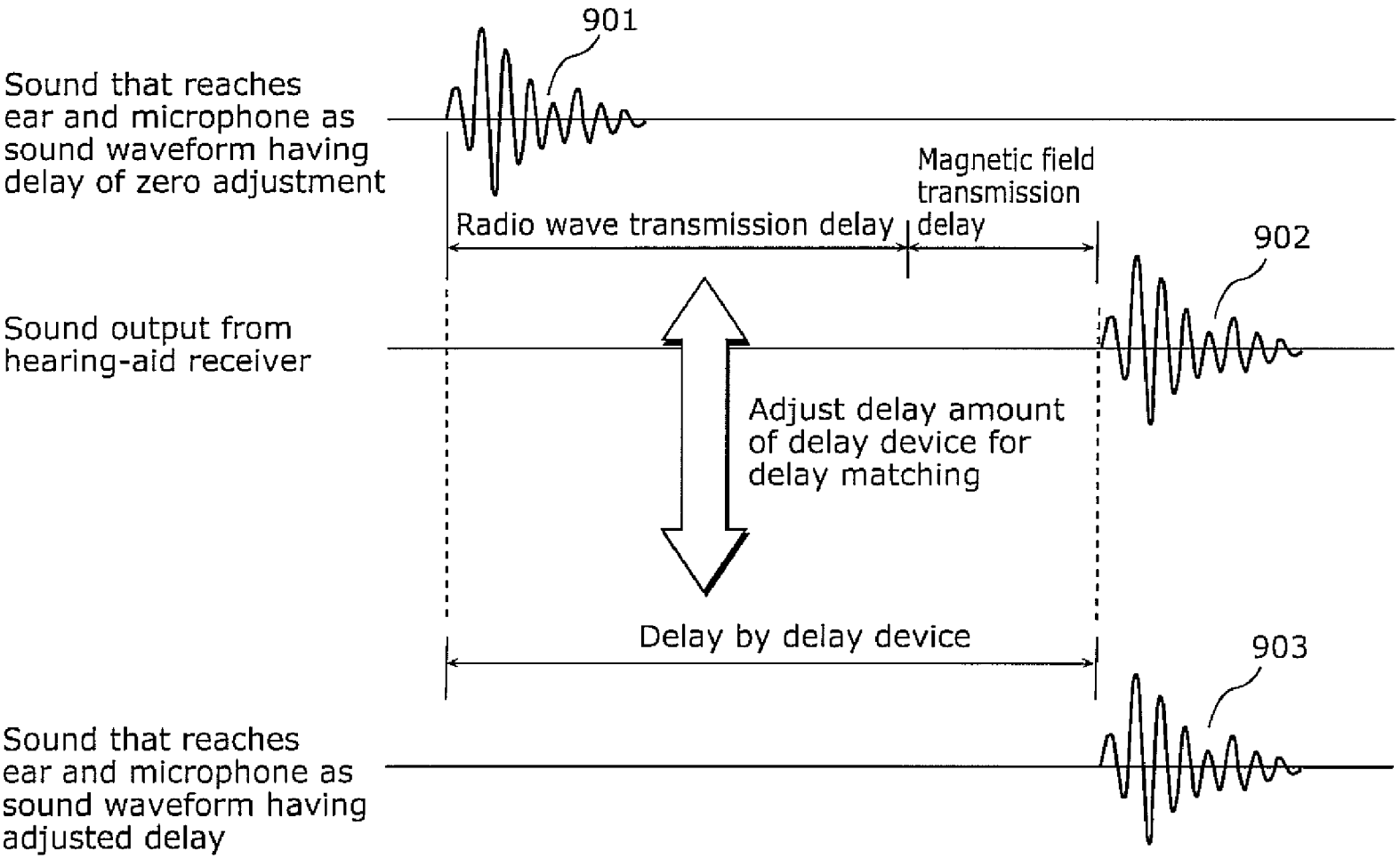
FIG. 20 is a schematic diagram showing the outline of delay adjustment processing.

Next, operations performed by the delay amount determining unit 580 and the control signal generating unit 585 are described in detail. It is known that time delay occurs in radio wave transmission and magnetic field transmission using digital schemes. As shown in FIG. 20, a time difference is made between an audio signal 901 that reaches an ear of a user and the microphone 501 and an audio signal 902 obtained by demodulating the transmission audio signal received through the relay device 42.

For this reason, the delay amount determining unit 580 calculates the time difference, that is, the amount of delay in transmission time, and the calculated delay amount to the control signal generating unit 585. This delay amount (also referred to as "delay time") is calculated by, for example, calculating a correlation function between the time waveform of the audio signal 901 that is the propagation sound and the time waveform of the audio signal 902 obtained by demodulating the transmission audio signal, and determining a time shift amount that yields the peak correlation value. For example, the delay amount determining unit 580 may include the same structural element as the correlation detecting unit 423 shown in FIG. 3, and may output, as a delay amount, the shift amount between the propagation sound and the transmission audio signal at the time of the detection of the peak.

The control signal generating unit 585 generates a control signal according to information about the delay amount output from the delay amount determining unit 580, and outputs the control signal to the magnetic field transmitting and receiving unit 545.

The magnetic field modulating unit 542 of the magnetic field transmitting and receiving unit 545 modulates the control signal according to the delay amount in the transmission time into a magnetic field transmission control signal. The magnetic field antenna 541 transmits by a magnetic field the modulated magnetic field transmission control signal to the relay device 43.

The magnetic field transmission control signal transmitted by the magnetic field is received by the magnetic field transmitting and receiving unit 455 of the relay device 42. The magnetic field transmission control signal received by the magnetic field antenna 451 of the magnetic field transmitting and receiving unit 455 is demodulated into a control signal by the magnetic field demodulating unit 453, modulated into a radio wave transmission control signal by the radio wave modulating unit 413, and transmitted by a radio wave from the radio wave antenna 411 to the AV apparatus 10. Through the relay device 42, the control signal is received by the radio wave receiver 80 of the AV apparatus 10.

The control signal received by the radio wave receiver 80 and demodulated is input to the delay device 70. Based on this control signal, the delay device 70 sets the same delay amount as the delay amount of the transmission time occurred in the radio wave transmission and magnetic field transmission. Based on the set delay amount, the delay device 70 delays the propagation sound that is amplified and output by the speaker 20 and propagates in the air as a sound wave. By shifting the output from the speaker 20 to a time position of the audio signal 903 in FIG. 20 in this way makes the audio signal 902 and the audio signal 903 match each other, and thereby compensates the time difference between the sound that directly reaches the ear of the user and the sound that is output from the receiver 530.

In this way, the hearing-aid system in Embodiment 4 is capable of reducing the time difference between a propagation sound that propagates in the air and reaches the ear of the user and the hearing aid 53 and the audio signal transmitted by a radio wave or a magnetic field and reaches the hearing aid 53, and thereby facilitates listening to the sound.

Although this hearing-aid system includes a single audio visual apparatus, the number of audio visual apparatuses is not limited to one, and a hearing-aid system including one or more audio visual apparatuses is possible. No complicated connection operation is required also in the case of a single audio visual apparatus, which provides an advantageous effect of increasing userfriendliness for the user of the hearing aid. As in Embodiments 1 to 3, the AV apparatus 10 is an apparatus such as a television set. Signal lines used to connect the AV apparatus 10 and either the radio wave transmitter 30 or the delay device 70 are, for example, an analog line signal, an optical digital signal, a co-axial digital signal, and an HDMI-support digital signal.

Alternatively, the speaker 20, the radio wave transmitter 30, and the delay device 70 may be embedded in the body of the AV apparatus 10. In this case, it is possible to easily set the system.

In addition, although an example of combining radio wave transmission and magnetic field transmission is described in Embodiment 4, inter-apparatus transmission schemes are not limited thereto. It is possible to arbitrarily combine and use radio waves, magnetic fields, infrared rays, visible light, supersonic waves, wires, etc.

Figure 21:
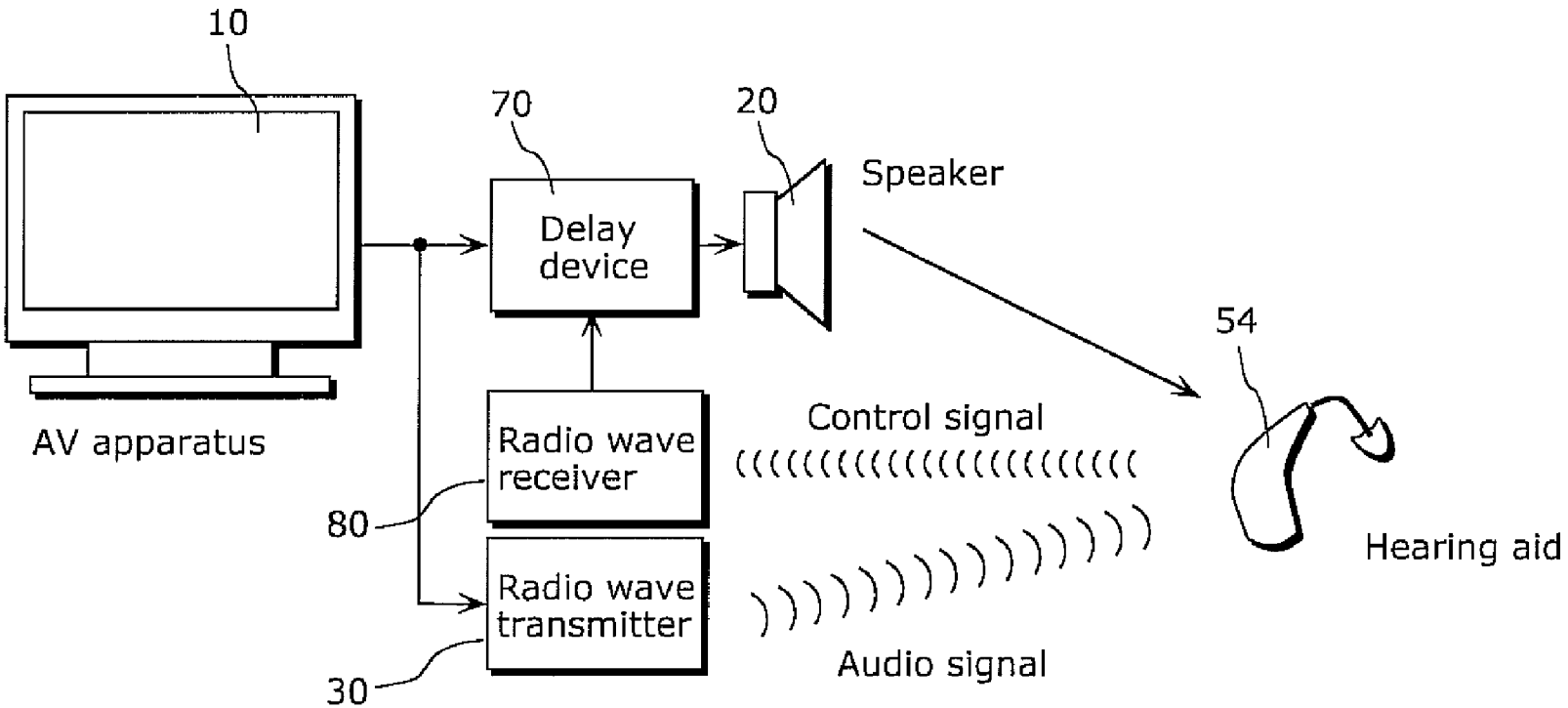
FIG. 21 is a structural diagram of another hearing-aid system in Embodiment 4.

Although the hearing-aid system in the above description performs relay by the relay device 42, it is also good that the hearing-aid system is configured to allow direct communication between a hearing aid 54 and an AV apparatuses 10 without relay by such a relay device as shown in FIG. 21.

Figure 22:
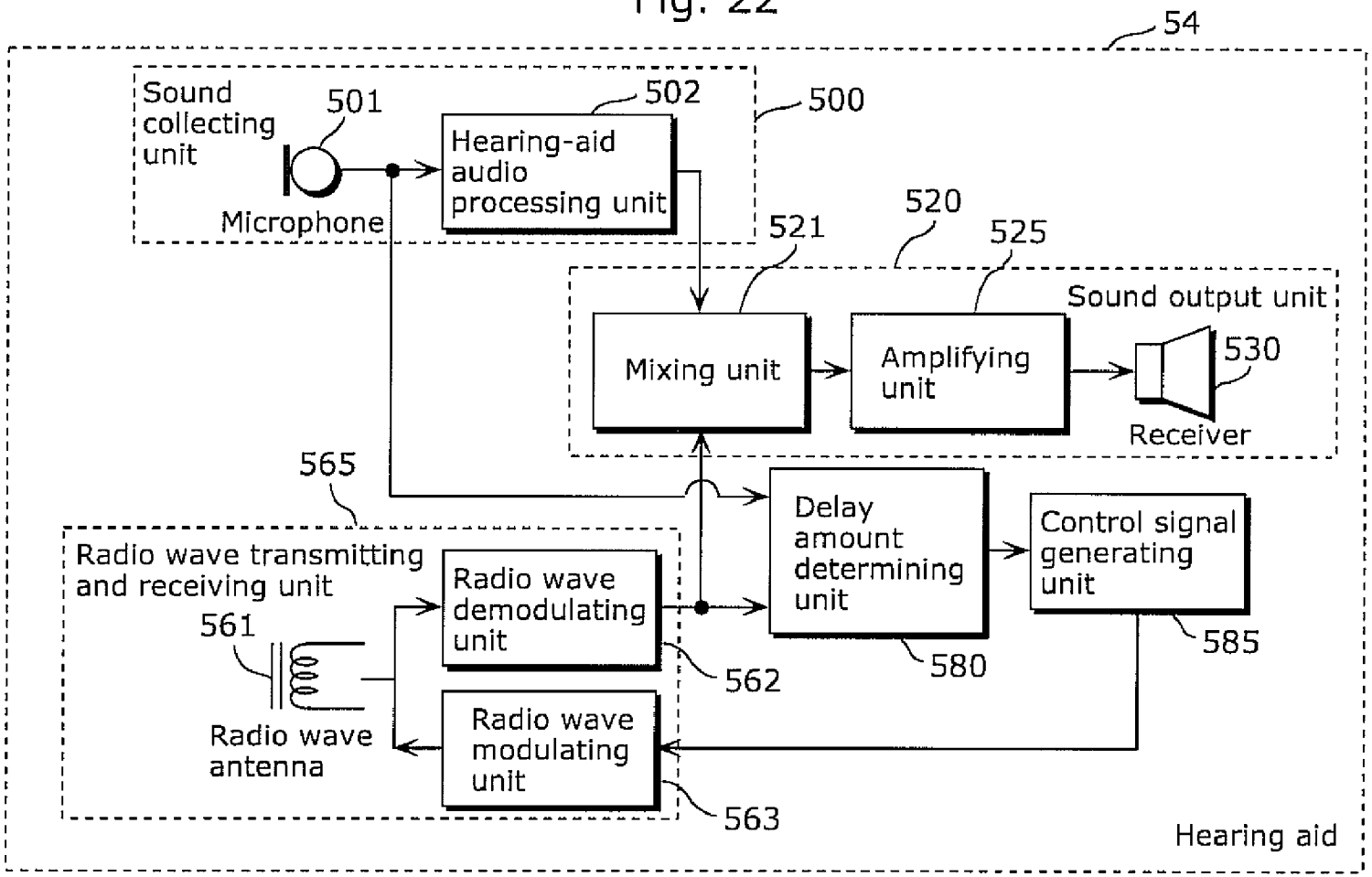
FIG. 22 is a functional block diagram of another hearing aid in Embodiment 4.

More specifically, as with the hearing aid 53, the hearing aid 54 shown in FIG. 22 includes: a sound collecting unit 500 including a microphone 501 and a hearing-aid audio processing unit 502; a sound output unit 520 including a mixing unit 521, an amplifying unit 525, and a receiver 530; a delay amount determining unit 580; and a control signal generating unit 585. In addition, the hearing aid 54 includes a radio wave transmitting and receiving unit 565 instead of a magnetic field transmitting and receiving unit 545 of the hearing aid 53.

The radio wave transmitting and receiving unit 565 includes: a radio wave antenna 561; a radio wave demodulating unit 562 configured to demodulate the radio wave transmission audio signal received by the radio wave antenna 561 into an audio signal, and output the demodulated audio signal to the mixing unit 521 and the delay amount determining unit 580; and a radio wave modulating unit 563 configured to modulate a control signal into a radio wave transmission control signal, and cause the radio wave antenna 561 to transmit the modulated control signal.

In the hearing aid 54 configured as shown in FIG. 22, the radio wave antenna 561 receives the radio wave transmission audio signal transmitted by a radio wave from the radio wave transmitter 30, and the radio wave demodulating unit 562 demodulates the received radio wave transmission audio signal into an audio signal. Furthermore, the demodulated audio signal is output to the mixing unit 521 and the delay amount determining unit 580.

The mixing unit 521, the amplifying unit 525, and the receiver 530 perform the same operations as in Embodiments 1 to 3. The delay amount determining unit 580 and the control signal generating unit 585 of the hearing aid 54 perform in a similar manner as performed by the counterparts in the hearing aid 53. The hearing aid 54 directly communicates with the AV apparatus 10, whereas the hearing aid 53 communicates with the AV apparatus 10 through the relay device 42. As with the hearing aid 51, the hearing aid 54 may include a comparing unit 550 including a correlation detecting unit 553, an interrupting unit 555, and a radio wave communication channel selection control unit 590. Alternatively, as with the hearing aid 52, the hearing aid 54 may include a comparing unit 550 including an ID detecting unit 551 and an ID comparing unit 552, and a radio wave communication channel selection control unit 590.

The hearing aid 54 having this structure without a relay device increases userfriendliness although the hearing aid 54 requires a circuit scale and power consumption larger than those for the hearing aid 53.

Embodiment 5

A relay device according to Embodiment 5 includes: a delay amount estimating unit configured to estimate a delay time of the transmission audio signal with respect to the propagation sound, by comparing collecting timing of the propagation sound collected by the sound collecting unit with receiving timing, by the hearing aid, of the transmission audio signal transmitted by the transmitting unit; and a transmitting unit configured to transmit, through the first transmission path, a control signal for causing the external apparatus which outputs the transmission audio signal selected by the comparing unit to output the propagation sound with a delay corresponding to the delay time estimated by the delay amount estimating unit.

Figure 23:
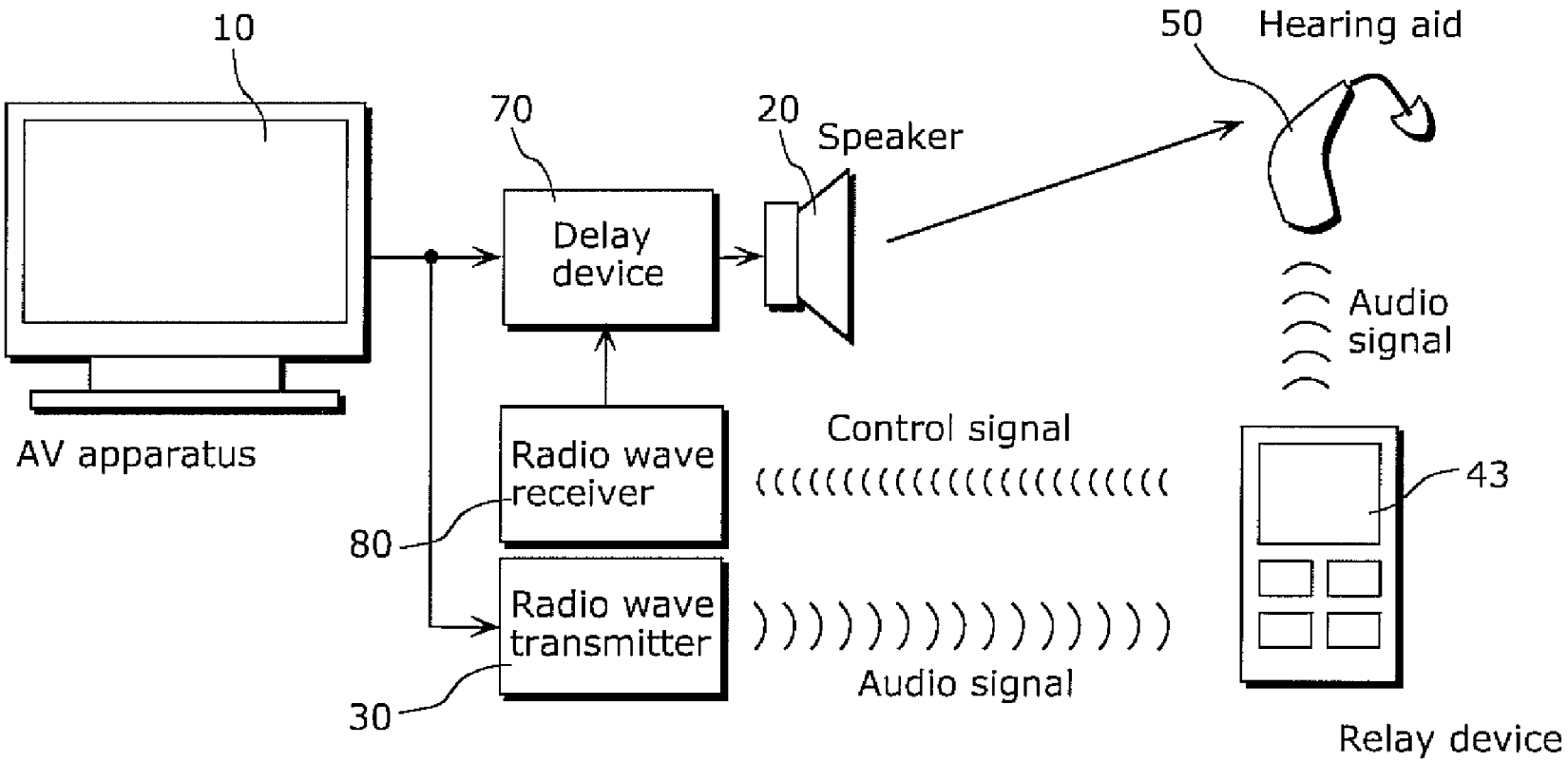
FIG. 23 is a structural diagram of a hearing-aid system in Embodiment 5.
Figure 24:
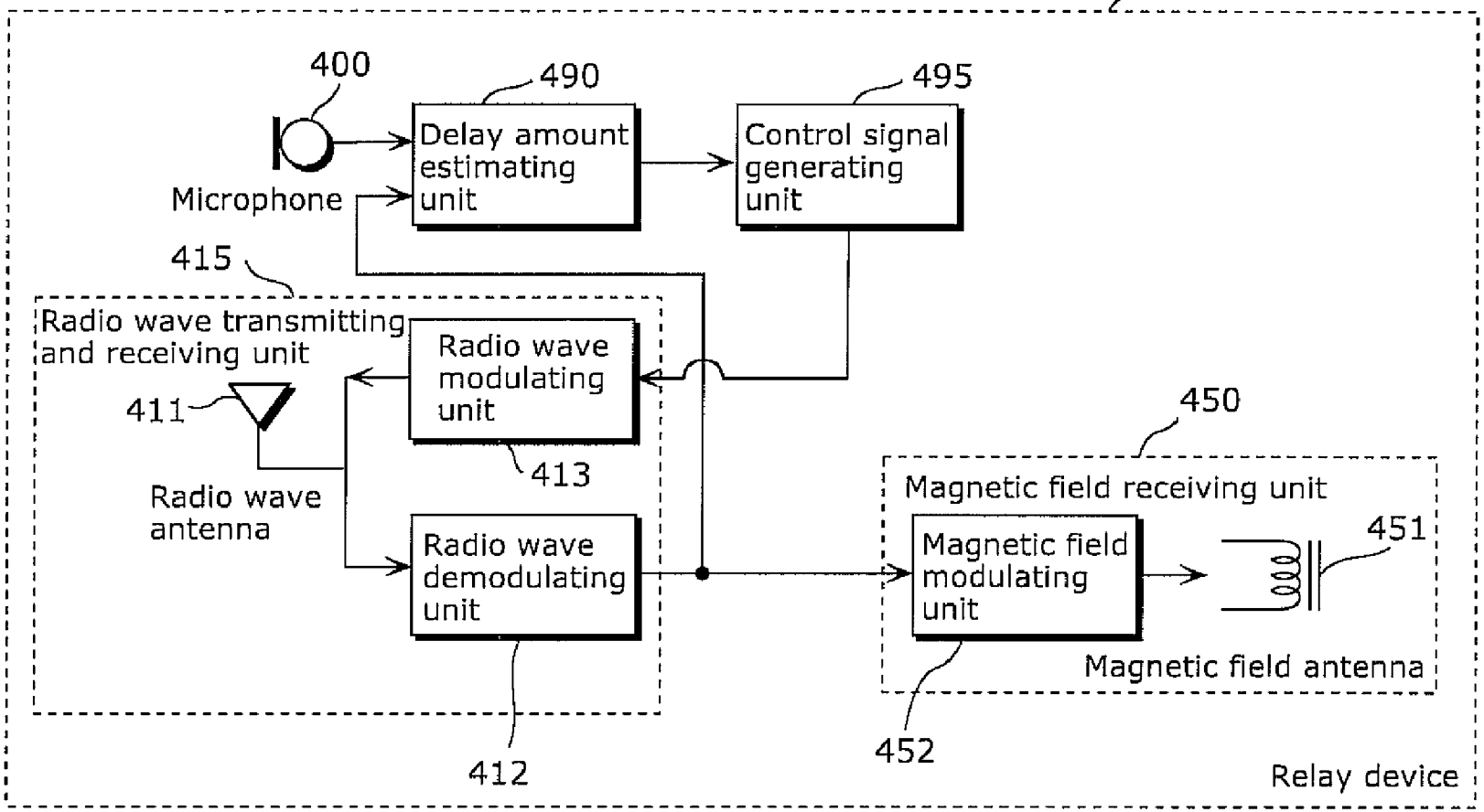
FIG. 24 is a functional block diagram of a relay device in Embodiment 5.

With reference to FIG. 23, a description is given of a structure of a hearing-aid system according to Embodiment 5 of the present invention. The hearing-aid system in Embodiment 5 is configured to include an AV apparatus 10, a relay device 43, and a hearing aid 50. As with Embodiment 4, a speaker 20, a radio wave transmitter 30, a delay device 70, and a radio wave receiver 80 are connected to the AV apparatus 10.

The hearing-aid system is different from the hearing-aid system in Embodiment 4 in that it can be configured using not a hearing aid 53 which determines a delay amount using a relay device 43 but using a hearing aid 50 which does not have such a function. The relay device 43 may include either a comparing unit 420 including a correlation detecting unit 423 or a comparing unit 420 including an ID detecting unit 421 and an ID comparing unit 422, and may further include a radio wave communication channel selection control unit 430. In the case where the relay device 43 does not include such structural elements, the hearing aid 50 may include a correlation detecting unit 553, an ID detecting unit 551, an ID comparing unit 552, an interrupting unit 555, a radio wave communication channel selection control unit 590, etc. The same structural elements as in Embodiments 1 to 4 are assigned with the same reference signs, and the descriptions thereof are not repeated.

The delay amount estimating unit 490 is configured to receive, as inputs, a propagation sound collected by the microphone 400 and an audio signal demodulated by the radio wave demodulating unit 412, and estimates the delay amount between the audio signals transmitted by radio waves or magnetic fields. The control signal generating unit 495 is configured to generate a delay control signal from an output from the delay amount estimating unit 490.

The relay device 43 has setting of a calculated time delay amount due to magnetic field transmission between the relay device 43 and the hearing aid 50. The delay amount estimating unit 490 estimates the time difference (the delay amount in transmission time) between the sound that directly reaches the ear of the user and the sound that is output from the hearing aid 50 through the relay device 43, by adding the pre-set delay amount in the magnetic field transmission to the time difference between the propagation sound from the microphone 400 and the sound of the audio signal from the radio wave demodulating unit 412. The control signal generating unit 495 generates a control signal according to this transmission time delay amount. Next, the radio wave transmitting and receiving unit 415 transmits by a radio wave this control signal to the radio wave receiver 80.

By delaying the sound that is amplified and output by the speaker 20 and propagates in the air as a sound wave in this way, it is possible to compensate the time difference between the sound wave that reaches the ear of the user and the sound that is output from the hearing aid 50.

The hearing-aid system can reduce the cost for the entire system because it can use the hearing aid 50 that requires small circuit scale and low power consumption although the accuracy in delay time adjustment achieved by this system is lower than that obtainable in the hearing-aid system in Embodiment 4.

Although this hearing-aid system includes a single audio visual apparatus, the number of audio visual apparatuses is not limited to one, and a hearing-aid system including one or more audio visual apparatuses is possible. No complicated connection operation is required also in the case of a single audio visual apparatus, which provides an advantageous effect of increasing userfriendliness for the user of the hearing aid. As in Embodiments 1 to 4, the AV apparatus 10 is an apparatus such as a television set. As with Embodiment 4, signal lines used to connect the AV apparatus 10 and either the radio wave transmitter 30 or the delay device 70 are, for example, analog line signals.

Alternatively, the speaker 20, the radio wave transmitter 30, the delay device 70, and the radio wave receiver 80 may be embedded in the body of the AV apparatus 10. In this case, it is possible to set the system more easily.

In addition, although an example of combining radio wave transmission and magnetic field transmission is described in this embodiment, inter-apparatus transmission schemes are not limited thereto. It is possible to arbitrarily combine and use radio waves, magnetic fields, infrared rays, visible light, supersonic waves, wires, etc.

Other Variation

Although the present invention has been described based on the embodiments of the present invention, the present invention is not limited thereto as a matter of course. The following cases are also included in the scope of the present invention.

(1) Each of the aforementioned apparatuses is, specifically, a computer system including a microprocessor, a ROM, a RAM, a hard disk unit, a display unit, a keyboard, a mouse, and so on. A computer program is stored in the RAM or hard disc unit. Here, each of the apparatuses exerts its function(s) when the microprocessor operates according to the computer program. Here, the computer program is configured by combining plural instruction codes indicating instructions for the computer in order to achieve predetermined functions.

(2) A part or all of the constituent elements constituting the respective apparatuses may be configured with a single system LSI (Large Scale Integration). The system LSI is a super-multi-function LSI manufactured by integrating constituent units on a signal chip, and is specifically a computer system configured to include a microprocessor, a ROM, a RAM, and so on. A computer program is stored in the RAM. The system LSI achieves its function through the microprocessor's operations according to the computer program.

(3) A part or all of the constituent elements constituting the respective apparatuses may be configured as an IC card which can be attached to and detached from the respective apparatuses or as a stand-alone module. The IC card or the module is a computer system configured from a microprocessor, a ROM, a RAM, and so on. The IC card or the module may also be included in the aforementioned super-multi-function LSI. The IC card or the module achieves its function through the microprocessor's operations according to the computer program. The IC card or the module may also be implemented to be tamper-resistant.

(4) The present invention may be implemented as methods corresponding to the above-shown apparatuses. Furthermore, the present invention may be implemented as computer programs for executing the above-described methods, using a computer, and may also be implemented as digital signals including the computer programs.

Furthermore, the present invention may be implemented as computer programs or digital signals recorded on computer-readable recording media. Examples of such computer-readable recording media include a flexible disc, a hard disk, a CD-ROM, an MO, a DVD, a DVD-ROM, a DVD-RAM, a BD (Blu-ray Disc), and a semiconductor memory. Furthermore, the present invention may be implemented as the digital signals recorded on these recording media.

Furthermore, the present invention may be implemented as the aforementioned computer programs or digital signals transmitted through a telecommunication line, a wireless or wired communication line, a network represented by the Internet, a data broadcast, and so on.

Furthermore, the present invention may be implemented as a computer system including a microprocessor and a memory, in which the memory stores the aforementioned computer program and the microprocessor operates according to the computer program.

Furthermore, it is also possible to execute another independent computer system by transmitting the programs or the digital signals recorded on the aforementioned recording media, or by transmitting the programs or digital signals through the aforementioned network and the like.

(5) It is also possible to arbitrarily combine the above-described embodiments and variations.

INDUSTRIAL APPLICABILITY

A hearing-aid system according to the present invention is capable of automatically switching connections between the hearing aid and the respective audio visual apparatuses, etc. without performing any special operation. Furthermore, the hearing-aid system is capable of reducing the time difference between the sound wave that propagates in the air and reaches the ear of a user and a microphone of the hearing aid and the audio signal that is transmitted by a radio wave or a magnetic field and reaches the hearing aid, and thereby facilitating listening of the sound. In this way, the present invention is highly useful for achieving a high-function hearing-aid system.

REFERENCE SIGNS LIST

10, 11 AV apparatus
20, 21 Speaker
30, 31 Radio wave transmitter
40, 41, 42, 43 Relay device
50, 51, 52, 53, 54 Hearing aid
60, 61 ID superimposing unit
70 Delay device
80 Radio wave receiver
400, 501 Microphone
410, 560 Radio wave receiving unit
411, 561 Radio wave antenna

412, 562 Radio wave modulating unit
413, 563 Radio wave demodulating unit
415, 565 Radio wave transmitting and receiving unit
420, 550 Comparing unit
421, 551 ID detecting unit
422, 552 ID comparing unit
423, 553 Correlation detecting unit
430, 590 Radio wave communication channel selection control unit
440 Magnetic field transmission control unit
450 Magnetic field transmitting unit
451, 541 Magnetic field antenna
452, 542 Magnetic field modulating unit
453, 543 Magnetic field demodulating unit
455, 545 Magnetic field transmitting and receiving unit
460 Notifying unit
470 Display screen
471 LEC lamp
490 Delay amount estimating unit
495, 585 Control signal generating unit
500 Sound collecting unit
502 Hearing-aid audio processing unit
520 Sound output unit
521 Mixing unit
525 Amplifying unit
530 Receiver
540 Magnetic field receiving unit
555 Interrupting unit
556 Notification sound generating unit
580 Delay amount determining unit
700, 701 Waveform memory
710 Convolution operation unit
720 Peak detecting unit
901, 902, 903 Audio signal

The invention claimed is:

1. A hearing aid which outputs, to a user, a sound obtained from a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds, said hearing aid comprising:

a sound collecting unit configured to collect one of the propagation sounds output from the respective external apparatuses;

a receiving unit configured to receive the transmission audio signals transmitted from the respective external apparatuses;

a comparing unit configured to compare the propagation sound collected by said sound collecting unit with each of the transmission audio signals received by said receiving unit, and select one of the transmission audio signals that corresponds to the propagation sound; and a sound output unit configured to output, to the user, the sound obtained from the transmission audio signal selected by said comparing unit.

2. The hearing aid according to claim 1, wherein said comparing unit is configured to calculate a correlation value between a waveform of the propagation sound and a waveform of a sound obtained from each of the transmission audio signals, and select, from among the transmission audio signals, a transmission audio signal having a correlation value exceeding a predetermined threshold value.

3. The hearing aid according to claim 1, further comprising:

a delay amount calculating unit configured to calculate a delay time of the transmission audio signal with respect to the propagation sound, by comparing collecting timing of the propagation sound collected by said sound collecting unit with receiving timing, in said receiving unit, of the transmission audio signal selected by said comparing unit; and a transmitting unit configured to transmit, through the first transmission path, a control signal for causing the external apparatus which outputs the transmission audio signal selected by said comparing unit to output the propagation sound with a delay corresponding to the delay time calculated by said delay amount calculating unit.

4. The hearing aid according to claim 1, wherein each of the external apparatuses superimposes apparatus identification information for identifying the external apparatus on the propagation sound and the transmission audio signal, and outputs the resulting propagation sound and the resulting transmission audio signal, and said comparing unit is configured to select, from among the transmission audio signals, the transmission audio signal that includes superimposed apparatus identification information identical to the apparatus identification information superimposed on the propagation sound.

5. The hearing aid according to claim 1, wherein said sound collecting unit is configured to collect a compound propagation sound including the propagation sound and a sound produced around the user, and said sound output unit includes:

a mixing unit configured to mix, at a predetermined mixing ratio, the compound propagation sound collected by said sound collecting unit and the sound obtained from the transmission audio signal selected by said comparing unit; and an amplifying unit configured to amplify the sound mixed by said mixing unit, and output the amplified sound to the user.

6. The hearing aid according to claim 5, further comprising a notifying unit configured to notify the user that the compound propagation sound and the sound obtained from the transmission audio signal have been mixed by said mixing unit.

7. A hearing-aid method of outputting, to a user, a sound obtained from a transmission audio signal obtained from one of external apparatuses, the respective external apparatuses outputting propagation sounds that propagate in air and transmit, on a first transmission path, transmission audio signals that include the transmission audio signal and correspond one-to-one to the propagation sounds, said hearing-aid method comprising:

collecting one of the propagation sounds output from the respective external apparatuses;

receiving the transmission audio signals transmitted from the respective external apparatuses;

comparing the propagation sound collected in said collecting with each of the transmission audio signals received in said receiving, and select one of the transmission audio signals that corresponds to the propagation sound; and outputting, to the user, the sound obtained from the transmission audio signal selected in said comparing.

* * * * *